US005363986A

United States Patent [19]

Cook

[11] Patent Number: 5,363,986

[45] Date of Patent: Nov. 15, 1994

[54] PACKAGES FOR SINGLE-USE FOLDED TOWELS WHICH PROVIDE FOR UNFOLDING OF THE TOWEL UPON REMOVAL FROM THE PACKAGE

[75] Inventor: Charles D. Cook, Fairfield, Ohio

[73] Assignee: The Procter & Gamble Company, Cincinnati, Ohio

[21] Appl. No.: 215,066

[22] Filed: Mar. 18, 1994

Related U.S. Application Data

[62] Division of Ser. No. 35,346, Mar. 22, 1993, Pat. No. 5,328,053.

[51] Int. Cl.[5] ..... B65H 1/00

[52] U.S. Cl. ..... 221/63; 206/484; 206/812

[58] Field of Search ..... 221/63, 45, 33, 64, 221/135; 206/210, 409, 438, 484, 63.3, 812

[56] References Cited

U.S. PATENT DOCUMENTS

| | | | |
|---|---|---|---|
| 1,039,899 | 10/1912 | Cole | 229/308 |
| 1,123,470 | 1/1915 | Betten | 206/440 |
| 1,212,349 | 1/1917 | Hardy | 206/39.6 |
| 1,228,251 | 5/1917 | Smith | 150/132 |
| 1,583,293 | 5/1926 | Horwitt | 211/51 |
| 1,628,981 | 5/1927 | Horwitt | 221/62 |
| 1,638,462 | 8/1927 | Ryan | 150/132 |
| 1,730,074 | 10/1929 | Horwitt | 206/496 |
| 1,980,059 | 11/1934 | Housen | 206/57 |
| 2,005,490 | 6/1935 | Baxter | 206/57 |
| 2,093,724 | 9/1937 | Horwitt | 206/494 |
| 2,118,473 | 5/1938 | Morris | 206/57 |
| 2,138,425 | 11/1938 | Morris | 206/57 |
| 2,211,494 | 8/1940 | Christman | 206/57 |
| 2,348,041 | 5/1944 | Warner | 206/57 |
| 2,402,982 | 7/1946 | Steenbergen | 206/63.2 |
| 2,629,419 | 2/1953 | Klein | 150/38 |
| 2,748,821 | 6/1956 | Hutchinson | 150/39 |
| 2,823,089 | 2/1958 | De Franco | 221/63 |
| 2,923,435 | 2/1960 | Chaplin | 221/47 |
| 3,266,544 | 8/1966 | Snyder | 150/38 |
| 3,285,405 | 11/1966 | Wanderer | 206/56 |
| 3,485,413 | 12/1969 | Vestal | 221/33 |
| 3,499,575 | 3/1970 | Rockefeller | 221/55 |
| 3,654,928 | 4/1972 | Duchane | 128/290 |
| 3,841,466 | 10/1974 | Hoffman et al. | 206/205 |
| 3,896,966 | 7/1975 | Canno | 221/63 |
| 3,976,076 | 8/1976 | Beach | 128/295 |
| 4,002,264 | 1/1977 | Marchesani | 221/63 |
| 4,131,195 | 12/1978 | Worrell, Sr. | 206/205 |
| 4,143,762 | 3/1979 | Spiegelberg | 206/210 |
| 4,168,000 | 9/1979 | MacRitchie | 206/63.3 |
| 4,180,160 | 12/1979 | Ogawa et al. | 206/210 |
| 4,185,754 | 1/1980 | Julius | 221/63 |
| 4,219,129 | 8/1980 | Sedgwick | 221/63 |
| 4,332,319 | 6/1982 | Hurwood | 206/210 |
| 4,387,832 | 6/1983 | Margulies | 221/63 |
| 4,550,855 | 11/1985 | Harrison | 221/63 |
| 4,580,695 | 4/1986 | Lum | 221/52 |
| 4,714,643 | 12/1987 | Kuenzel | 428/131 |
| 4,890,744 | 1/1990 | Lane, Jr. et al. | 206/484 |
| 4,938,347 | 7/1990 | Tillman | 206/812 |
| 5,025,524 | 6/1991 | Genovese, Jr. | 15/104.94 |
| 5,076,465 | 12/1991 | Lawson | 221/47 |
| 5,246,137 | 9/1993 | Schatz et al. | 221/63 |

*Primary Examiner*—Kenneth W. Noland

*Attorney, Agent, or Firm*—William Scott Andes; Michael E. Hilton; Jacobus C. Rasser

[57] ABSTRACT

The present invention presents improved packages for single-use, disposable folded towels, and more particularly to single- and multi-towel packages which provide for readily grasping a defined portion of the towel upon opening the package and automatic unfolding of the towel upon removal from the package without a separate unfolding step requiring additional consumer action. Single-towel embodiments are disclosed which provide for complete unfolding of the towel by the use of: (a) an opening bearing a particular geometrical relationship to the dimensions of the folded towel; or (b) a flexible bar within the package to provide unfolding of the towel in the longitudinal direction. A multi-towel embodiment which provides for the advantageous dispensing features and convenience of an improved single-towel package while providing the added capability of multi-towel transportation is also disclosed. These packages provide for complete containment and protection of the folded towel prior to use, while providing ease of dispensing and unfolding for the consumer at the time of use. Several methods of folding folded towels for use with packages according to the present invention are also disclosed, as well as various methods of fabricating the improved packages according to the present invention.

21 Claims, 25 Drawing Sheets

PACKAGES FOR SINGLE-USE FOLDED TOWELS WHICH PROVIDE FOR UNFOLDING OF THE TOWEL UPON REMOVAL FROM THE PACKAGE

CROSS-REFERENCE TO RELATED APPLICATION

This application is a division of application Ser. No. 08/035,346, filed Mar. 22, 1993 now U.S. Pat. No. 5,328,053.

FIELD OF THE INVENTION

The present invention pertains to improvements in packages for single-use, disposable folded towels. More particularly, the present invention pertains to flexible packages which provide for fully automatic unfolding of a two-directionally folded towel upon removal from the package without a separate unfolding step requiring additional consumer action. The present invention also pertains to flexible packages which provide for automatic unfolding in the withdrawing direction of a two-directionally folded towel upon removal from the package. Both single-towel and multi-towel packages incorporating these advantageous features are presented.

BACKGROUND OF THE INVENTION

In today's society, cleanliness is very important both from a health standpoint and an aesthetic standpoint. However, when one is away from home it is much more difficult to perform personal cleansing due to unavailability of traditional cleansing tools such as soap, cloths, and running water. Cleansing of sensitive areas of the body also requires special consideration, as ordinary towel products, cleansing agents, and other associated materials such as disinfectants may cause irritation and discomfort.

To address this problem, manufacturers of consumer products have developed disposable, paper-based towel products which are pre-moistened with a non-irritating cleansing agent. As used herein, the terms "single-use" and "disposable" are used interchangeably to refer to towels and packages which are to be used once and then discarded, rather than retained (and perhaps cleaned) for reuse. There are two basic types of containers for such pre-moistened towel products, namely multi-towel containers and single-towel disposable packages.

In a typical multi-towel container, a flexible or rigid moisture-impervious container is utilized. The pre-moistened towel products are either on a roll, with perforations defining the ends of individual towels, or in some sort of folded, stacked relationship such that one towel at a time (or in some cases, more than one) is presented to the consumer and can readily be extracted from the container. These containers thus typically promote easy dispensing of individual towels, and are usually recloseable to protect the remaining towels. The major drawback of most multi-towel containers is that, because of the number of towels contained, of necessity they have a significant amount of bulk, are awkward to carry away from home, and render discretion in use practically impossible.

Pocket-sized, single-towel disposable packages designed for away-from-home use avoid the bulk and awkwardness of the multi-towel containers, but are not without drawbacks. Most such packages do not have a defined portion of the towel which is presented to the consumer upon opening the package, and hence the consumer must typically reach inside the package and fish about for the folded towel to grasp and extract it. Due to the lack of a roll of towels to feed from and/or other towels to interact with, in a typical single-towel package the folded pre-moistened towel is typically dispensed as a small, tightly folded moist pad consisting of the towel as it remains folded in two directions, i.e., along major axes of the towel. The consumer must then manually unfold this small pad of material to have the entire extent of the towel available for use. This is an undesirable and time-consuming process requiring two hands to accomplish, and without which the towel is of little practical use. The pre-moistened nature of the towel exaggerates this problem. The amount of handling of the towel which this unfolding requires also presents a significant likelihood of contamination of the towel prior to actual use.

The present invention is directed to improving single- and multi-towel packages to provide the advantageous accessibility and unfolding features of multi-towel containers while retaining the transportability and concealability of a single-towel disposable package, and thus increase consumer satisfaction with this type of product. A plurality of such single-towel packages, or multi-towel variations of such packages, may thus provide comfort and convenience as might be required for a day of traveling or a full day away from home. Specific attributes and advantages of this invention will be apparent with reference to the accompanying Specification and Drawing Figures.

SUMMARY OF THE INVENTION

The drawbacks of typical single-towel disposable packages may be remedied by providing some means for presenting the towel for grasping by the consumer, as well as some means to interact with the folded towel upon removal from the package so as to cause it to unfold. Of the possible ways of accomplishing this interaction, most must be ruled out as too costly, too complex, or too bulky in the context of such a pocket-sized, single-towel disposable package.

Packages according to the present invention provide the advantageous accessibility and unfolding features of multi-towel containers while retaining the transportability and concealability of a single-towel package by providing a package design in which elements of the package itself provide greater accessibility of defined portions of the towel for grasping, and interact with the folded towel to provide the desired unfolding action. The total package remains compact, flexible, liquid-impervious, and simple in its construction. Simplicity equates to low manufacturing costs and reliability in consumer usage.

The present invention consists of three basic package configurations which, in combination with the action of removing a folded, pre-moistened towel, unfold the towel for use. Such packages are sized, and the towels folded to a corresponding size, so as to be appropriate for carrying in a pocket, travel bag, or purse for use away from home.

In a first embodiment of the present invention, a package slightly larger than the folded towel is utilized. On one side, the package has an elongated opening with a major dimension slightly smaller than the minor dimension (width) of the folded towel and a minor dimension slightly larger than the thickness of the leading edge of the folded towel. At the end of the towel adjacent to the opening, the towel has a grasping portion which provides a grasping point for the consumer. When the consumer exposes/opens this opening, grasps the grasping portion, and withdraws the folded towel, it completely unfolds the towel, leaving the consumer holding a fully unfolded, ready-to-use towel. The geometrical relationship between the opening and the folded towel is the key to the unfolding performance of this embodiment of the present invention.

In a second embodiment according to the present invention, a package again slightly larger than the folded towel is utilized. At one end, the package tapers down to a pre-determined width which, when torn open by the consumer, provides an elongated opening having a major dimension slightly smaller than the minor dimension (width) of the folded towel. At the end adjacent to the tapered end, the towel has a grasping portion which provides a grasping point for the consumer. When the consumer tears open the tapered end of the package, grasps the grasping portion, and withdraws the folded towel, it completely unfolds the towel, leaving the consumer holding a fully unfolded, ready-to-use towel. The geometrical relationship between the opening formed by tearing open the tapered end and the folded towel is the key to the unfolding performance of this embodiment of the present invention.

In a third embodiment according to the present invention, a package again slightly larger than the folded towel is utilized. At one edge, the package is designed to be torn open by the consumer to expose one end of the folded towel. Inside the package, extending completely across the width of the package from one side seam to the other, a flexible bar-like member formed of a thin, flexible material is located up to approximately one-fourth to one-half of the way down from the leading edge of the folded towel. This bar-like member is interleaved with the folds of the towel such that, when the consumer tears open the package, grasps the leading edge of the towel, and withdraws the towel, it fully unfolds the towel in the lateral direction. The consumer then merely has to unfold the towel in the longitudinal direction. The key to the unfolding performance of this embodiment of the present invention is the bar-like member forcing the towel to unfold and pass behind it on the way out through the open edge of the package. This embodiment is particularly well-suited for adaptation as a multi-towel package.

BRIEF DESCRIPTION OF THE DRAWINGS

The present invention will be better understood with reference to the following Detailed Description and to the accompanying Drawing Figures, in which.

DETAILED DESCRIPTION OF THE PREFERRED EMBODIMENTS

Figure 1:
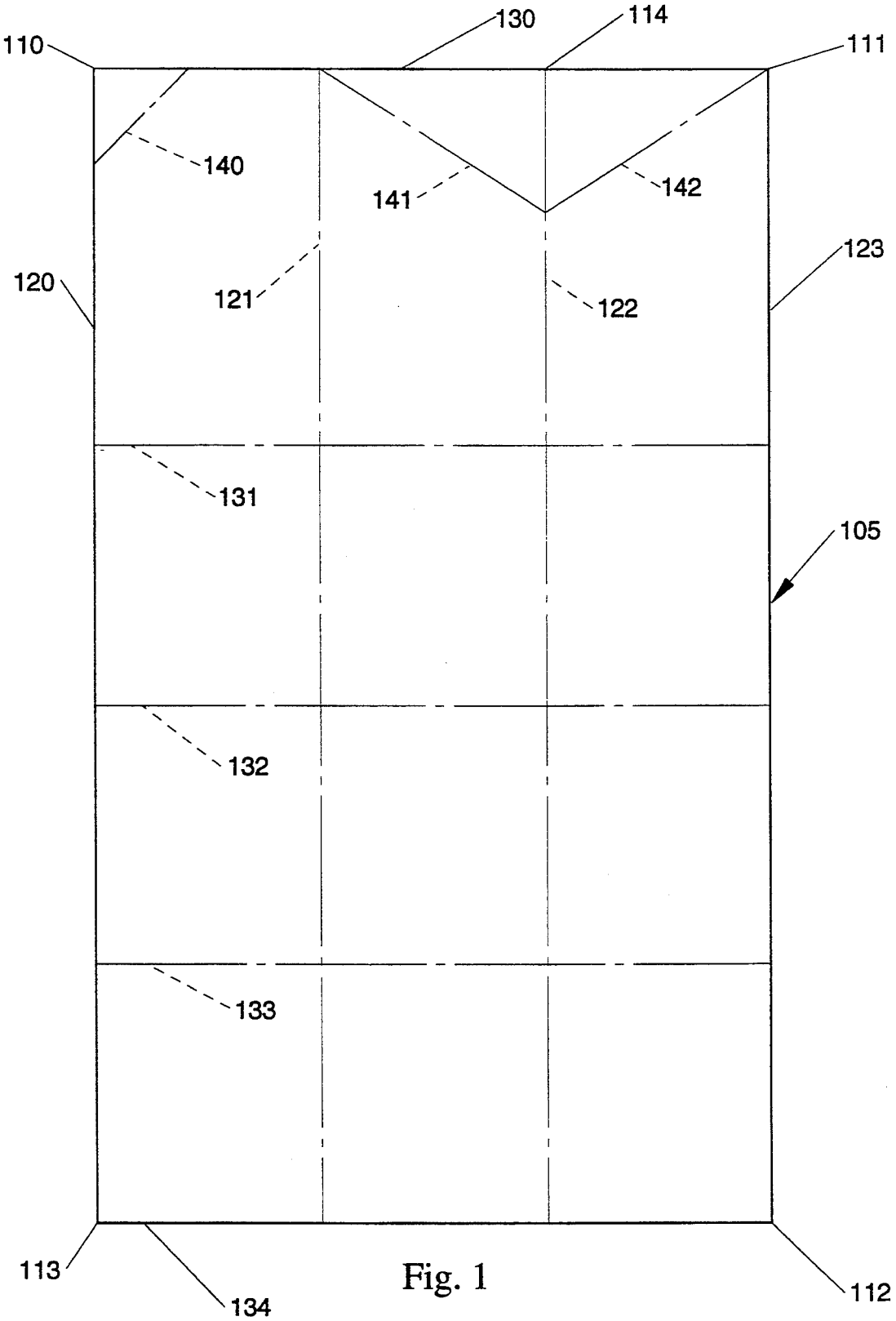
FIG. 1 is a plan view of an unfolded towel according to a first embodiment of the present invention.

What follows is a description of three possible embodiments of improved packages according to the present invention. While each is accompanied by a description of a presently preferred manner of folding a folded towel for use with each package, it is to be understood that there are many possible ways of folding towels for use with such improved packages, so long as certain common attributes are maintained. These key attributes will be identified with respect to each configuration discussed below.

Before proceeding further, it would be helpful to define certain recurring terms with respect to the present invention.

First, the term "flexible" is intended to encompass materials which are easily bent and conform to irregular surfaces as, for example, materials flexible enough to be carried in one's pocket or purse relatively unobtrusively and without discomfort, as well as materials which are flexible enough to perform the desired wiping or cleansing tasks.

The term "thin" refers to materials having thicknesses which are substantially less than their length and/or width such as, for example, various sheet-like and cord-like materials. Such materials; may typically have thickness on the order of about 1/16 inches (1.59 mm) or less, although somewhat thicker materials may be utilized if they have sufficient flexibility for use with packages according to the present invention, as discussed above.

The term "liquid-impervious" is intended to encompass materials which generally deny penetration of liquid material through them in either direction, such as into or out of a package formed of such a material, the liquid being any common, non-toxic liquid which will not physically compromise the integrity of the package.

In the Drawing Figures, FIGS. 1 through 5D depict an improved package and folded towel according to a first embodiment of the present invention.

FIG. 1 illustrates a towel for use with a package according to a first embodiment of the present invention, which is depicted in its unfolded state. The numeral 105 the towel generally, and the numerals 110, 111, 112, and 113 are used to identify the four corners of the towel 105, which may be generally rectangular in shape in a preferred configuration. The towel 105 also has two side edges 120 and 123, a leading edge 130, and a trailing edge 134.

In FIG. 1, the fold lines of towel 105 are illustrated through the use of dotted lines. In a preferred configuration, the towel has two longitudinal fold lines 121 and 122 parallel to the side edges, and three lateral fold lines 131, 132, and 133 parallel to the leading and trailing edges. The longitudinal fold lines and lateral fold lines are thus mutually orthogonal. The towel 105 also preferably has three diagonal fold lines 140, 141, and 142 adjacent to leading edge 130.

Figure 2A:
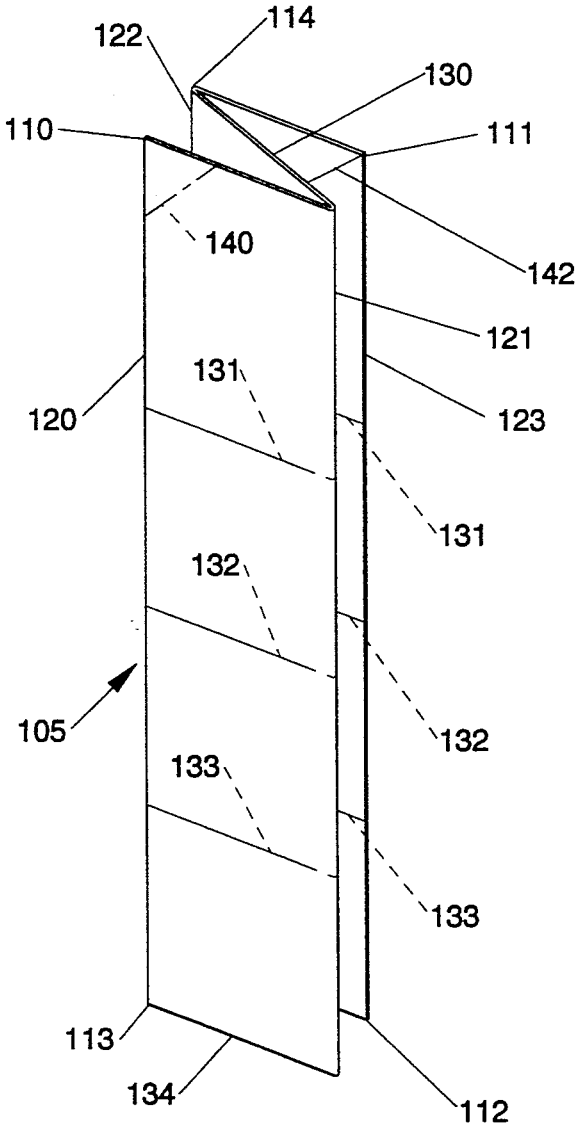
FIGS. 2A through 2C are perspective views depicting the steps required to fold a towel such as depicted in FIG. 1.
Figure 2B:
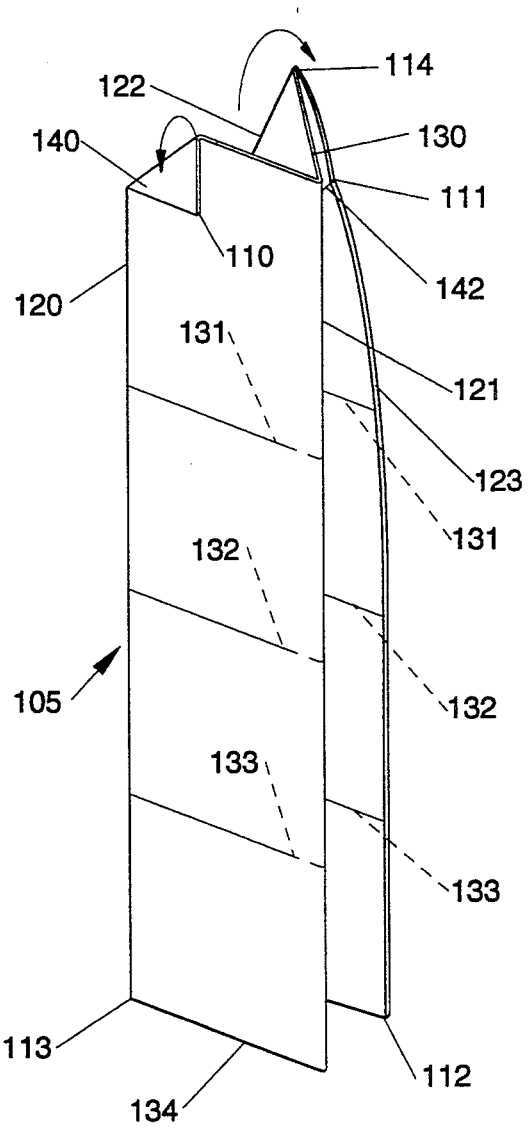
Figure 2C:
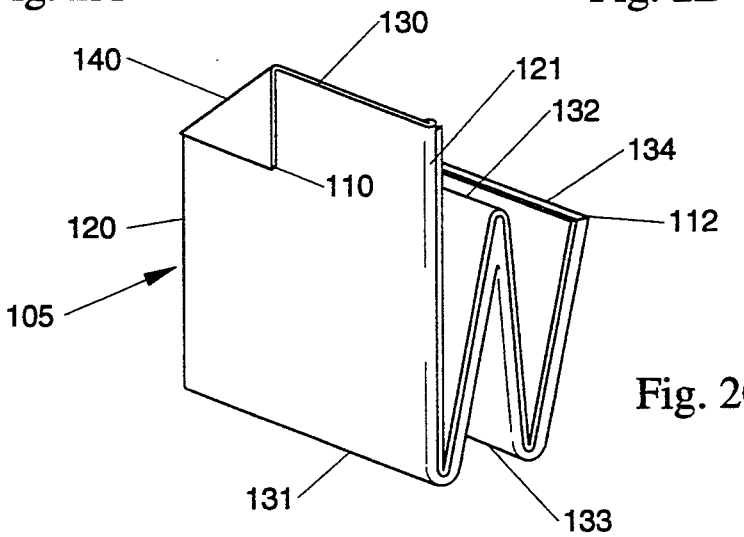

FIGS. 2A through 2C depict the folding process to fold the towel 105 depicted in FIG. 1.

In FIG. 2A, the towel 105 has been z-folded along fold lines 121 and 122 such that side edge 120 overlies fold line 122, and side edge 123 is behind fold line 121. This folding step has now also formed a rear corner 114, the use of which becomes apparent in FIG. 2B. This folding operation has defined the folded width (FW) of the folded towel, measured parallel to the lateral fold lines, and has also defined a first folded thickness (FFT), which is the thickness of the overlying longitudinally folded portions of the towel.

In FIG. 2B, the corner 110 has been folded diagonally downward and forward to form a free corner, and hence a grasping portion for extracting the folded towel from the improved package. In addition, rear corner 114 is shown being folded diagonally downward and rearward along fold lines 141 and 142 so as to isolate the portion of the leading edge 130 adjacent to the grasping portion formed by free corner 110. This ensures that the consumer will only grasp the front thickness of the folded sheet, and that only by free corner 110, rather than grasping the entire thickness of the folded sheet or one of the more rearward layers. Corner 110 will be the first portion of the towel to be withdrawn from the package, initiating the withdrawal of leading edge 130. Trailing edge 134 will be the last portion of the towel to be removed from the package.

In FIG. 2C, the towel 105 folded according to FIGS. 2A and 2B has now been accordion-folded along lateral fold lines 131–133 such that fold line 131 overlies fold line 133. The portion of leading edge 130 which is adjacent to the free corner 110 extends beyond fold line 132 and trailing edge 134 to ensure proper unfolding of the towel. This folding operation has defined the folded length (FL) of the folded towel, measured parallel to the longitudinal fold lines, and has also defined a second folded thickness (SFT), which is the thickness of the overlying laterally folded portions of the towel.

Figure 3A:
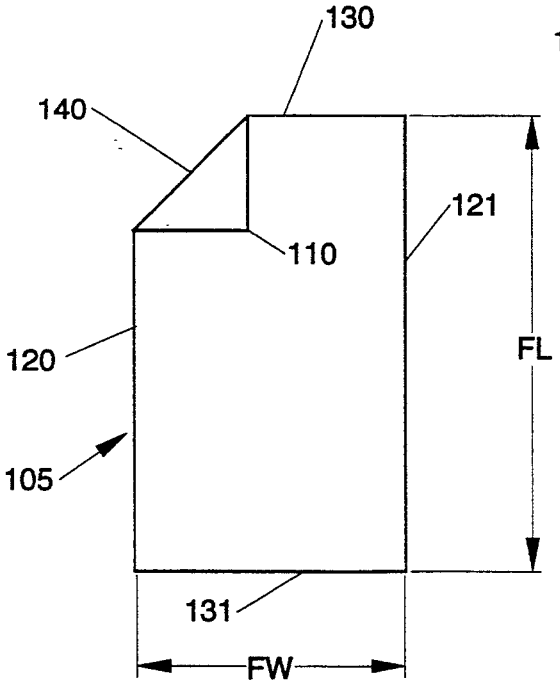
FIGS. 3A and 3B are plan views of a towel folded according to FIGS. 2A–2B, with FIG. 3A depicting a front view and FIG. 3B depicting a back view.
Figure 3B:
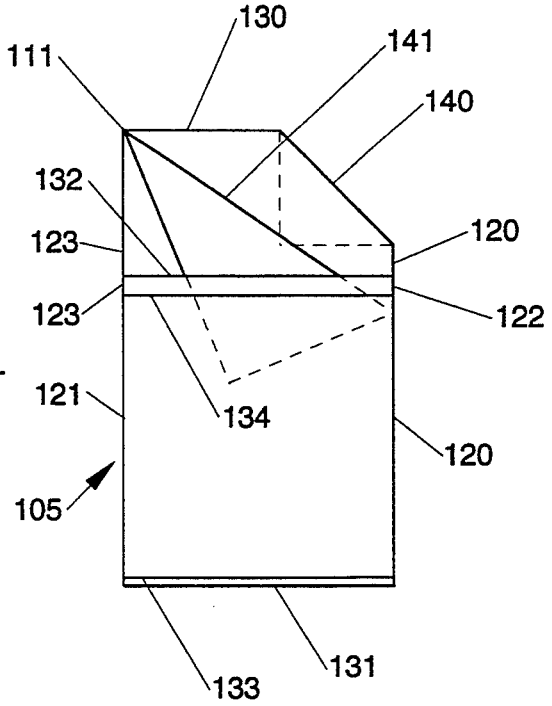

FIGS. 3A and 3B depict front and rear views, respectively, of the towel 105 after it has been folded according to the process depicted in FIGS. 2A–2C and pressed flat so as to occupy minimal space. The folded towel 105 preferably exhibits a generally rectangular outline, save for the corner 110 folded downward via fold line 140. The distance between leading edge 130 and fold line 131 (measured parallel to the longitudinal fold lines 121 and 122) defines the folded length (FL), and the distance between side edge 120 and fold line 121 (measured parallel to the lateral fold lines 131–133) defines the folded width (FW). As the longitudinal fold lines and lateral fold lines are mutually orthogonal, the folded length and folded width are also mutually orthogonal.

The various elements of the folded towel 105 which are visible in the folded state are labeled in FIGS. 3A and 3B to show their final position following the folding operation. The relative positions of these elements of the folded towel have proven to be critical to proper unfolding of the towel as described below with regard to FIGS. 5A–5D.

Figure 3C:
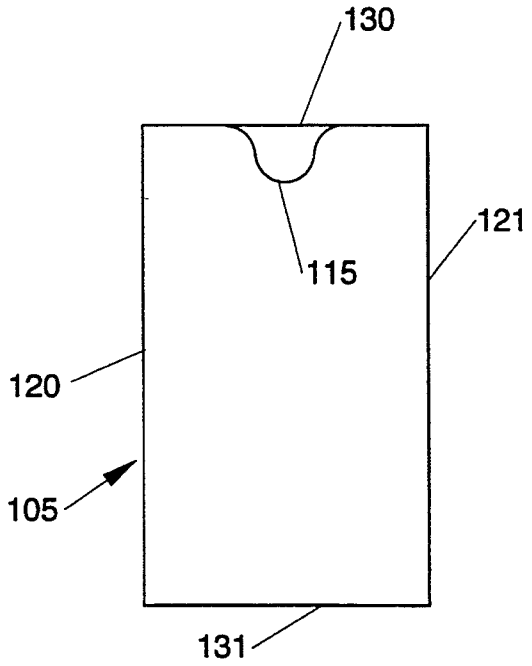
FIGS. 3C and 3D are frontal plan views of alternative folded towel configurations suitable for use with packages according to the first embodiment of the present invention.

While a presently preferred manner of folding the folded towel according to this first embodiment of the present invention has been set forth, there are many other ways to fold a towel so as to obtain satisfactory performance with this improved package. For example, the folding methods described with respect to FIGS. 7A–7C and FIGS. 12A–12B could be utilized, or any other similar method which incorporates a greater or lesser number of folds. In addition, the grasping portion could be formed as a projection 115 on the leading edge of the folded towel, such as shown in FIG. 3C, and folded downward over the front surface of the folded towel so as to align with the opening.

There are three critical aspects of the towel folding operation according to this first embodiment of the present invention. First, the towel in its finally folded state must have a generally rectangular overall shape. Second, a grasping portion must be in underlying registry with the defined opening 152, as shown in FIG. 5B, so as to present a defined portion of the towel for the consumer to grasp and withdraw the folded towel by its leading edge. Finally, the towel must be folded longitudinally first, and then laterally, with the longitudinal and lateral folds being generally orthogonal to one another, so as to permit the lateral folds to unfold first, and then the longitudinal folds, as described below with respect to FIGS. 5A–5D.

FIGS. 4A through 4D illustrate the steps required to assemble a complete package according to this first embodiment of the present invention.

Figure 4A:
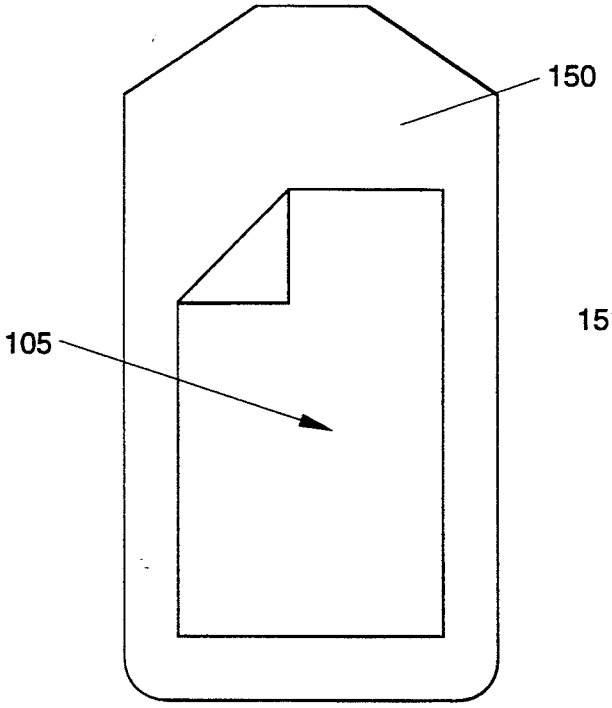
FIGS. 4A through 4D are plan views depicting the steps required to assemble an improved package according to a first embodiment of the present invention.

In FIG. 4A, the folded towel 105 has been placed on top of a back sheet 150, which comprises a sheet of thin, flexible, and preferably liquid-impervious material. Back sheet 150 is sized so as to be marginally larger than the folded width and somewhat larger than the folded length of the folded towel 105.

Figure 4B:
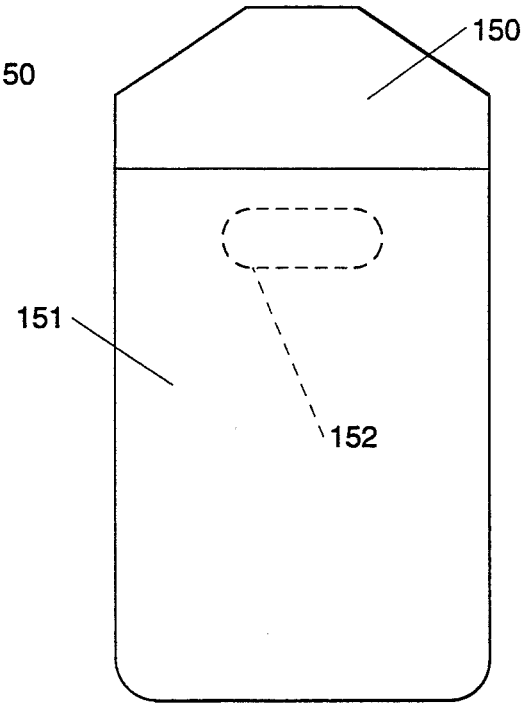

In FIG. 4B, a front sheet 151 has been placed over the folded towel 105 and back sheet 150. Front sheet 151 also comprises a sheet of thin, flexible, and preferably liquid-impervious material, and front sheet 151 has a size and shape which generally correspond to the size and shape of the back sheet 150, but having a shorter length than back sheet 150. Front sheet 151 further includes an opening 152, which is represented by the dotted line.

Figure 4C:
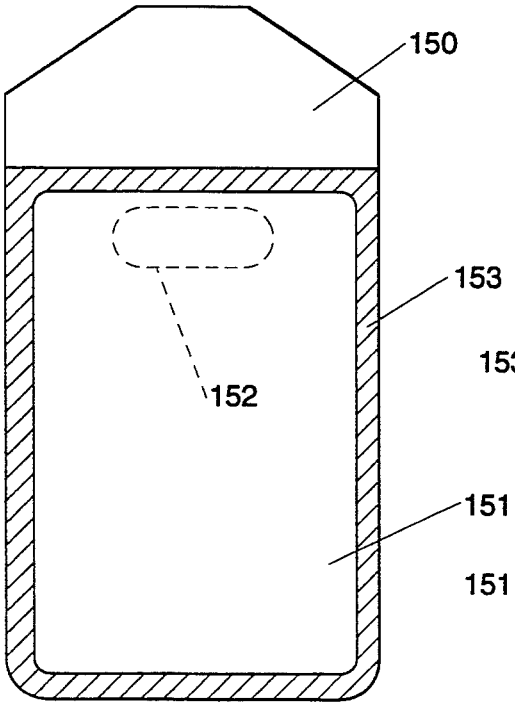

In FIG. 4C, front sheet 151 and back sheet 150 have been sealed together around the periphery of front sheet 151, as shown at 153, to contain the folded towel. Opening 152 must be in overlying spaced relation to and in registry with free corner 110, such that when closure 154 is removed the consumer has access to and can grasp free corner 110 to withdraw and unfold the folded towel 105.

Figure 4D:
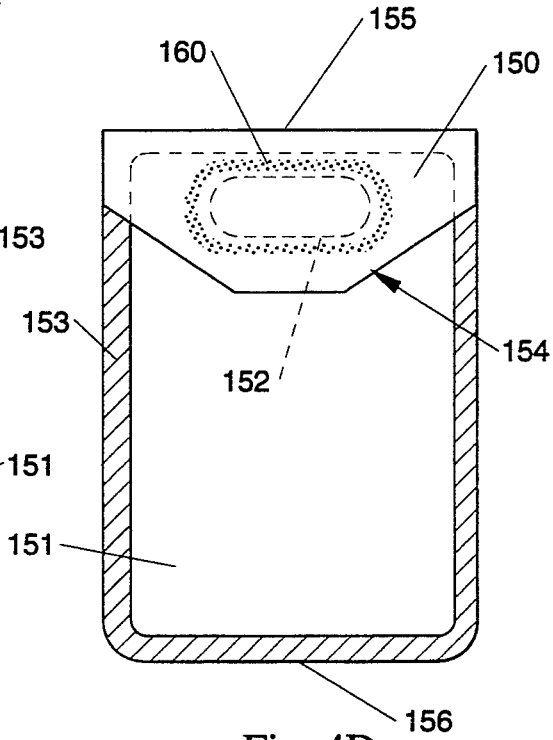

FIG. 4D depicts the completed package, after the portion of back sheet 150 which protrudes beyond front sheet 151 has been folded downward over opening 152 and bonded to front sheet 151 around the periphery of opening 152 (as shown by stippled region 160) so as to constitute a closure 154. The folded towel 105 is now completely contained inside an airtight and moisture-tight package, where it will remain clean and ready for use.

FIGS. 5A through 5D depict the process of opening the completed package and extracting the folded towel according to the first embodiment of the present invention.

Figure 5A:
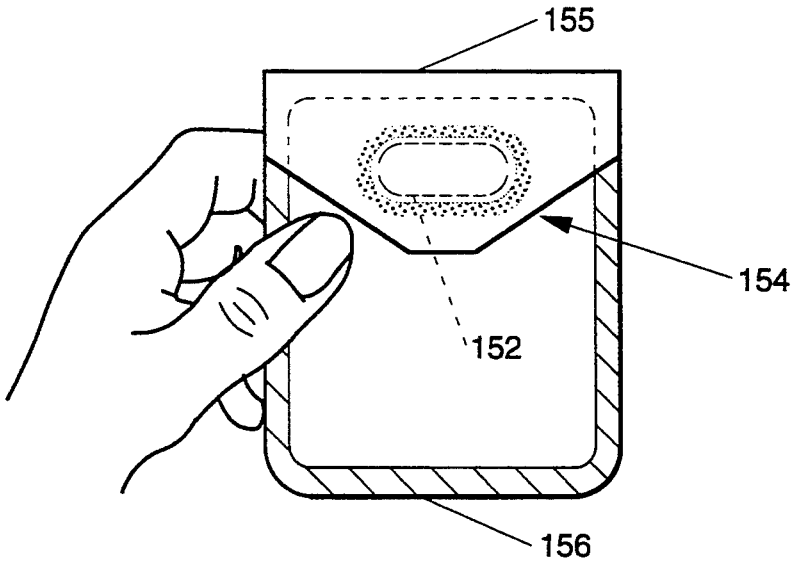
FIGS. 5A through 5D are perspective views depicting the steps required to open an improved package and remove the folded towel according to the first embodiment of the present invention.
Figure 5B:
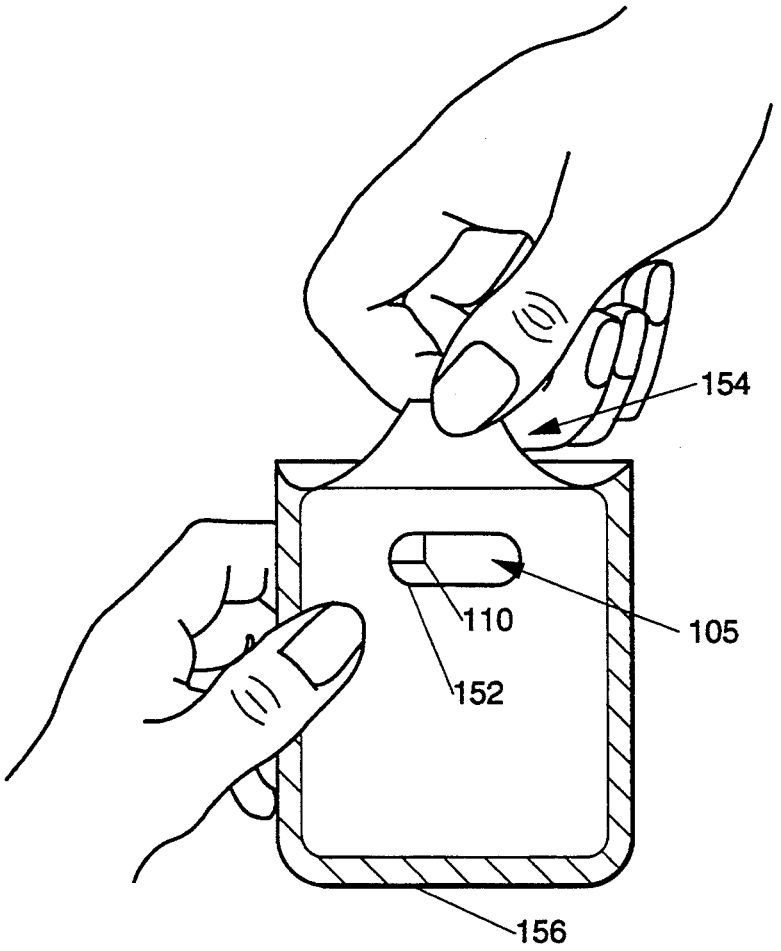

In FIG. 5A, the consumer has grasped the completed package at one side just below opening 152 with one hand. The consumer then grasps the end of closure 154 nearest to the first hand with his or her other hand and, by pulling the closure upward and across the package as shown in FIG. 5B, peels the closure so as to expose opening 152. As shown in FIG. 5B, this step leaves the opening exposed and provides access to the folded towel 105, with the free corner 110 in registry with opening 152.

Figure 5C:
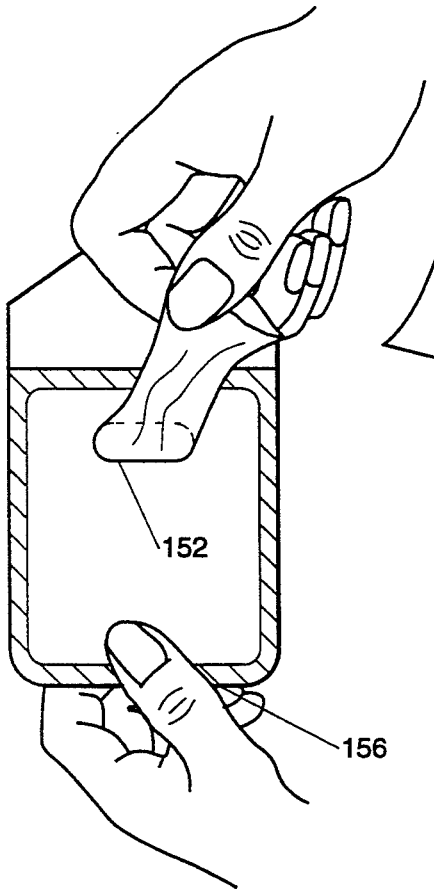

The consumer in FIG. 5C has now shifted one hand so as to grasp the lower edge 156 of the package with one hand and has grasped the free corner 110 with the other hand so as to begin extracting the folded towel from the package.

Figure 5D:
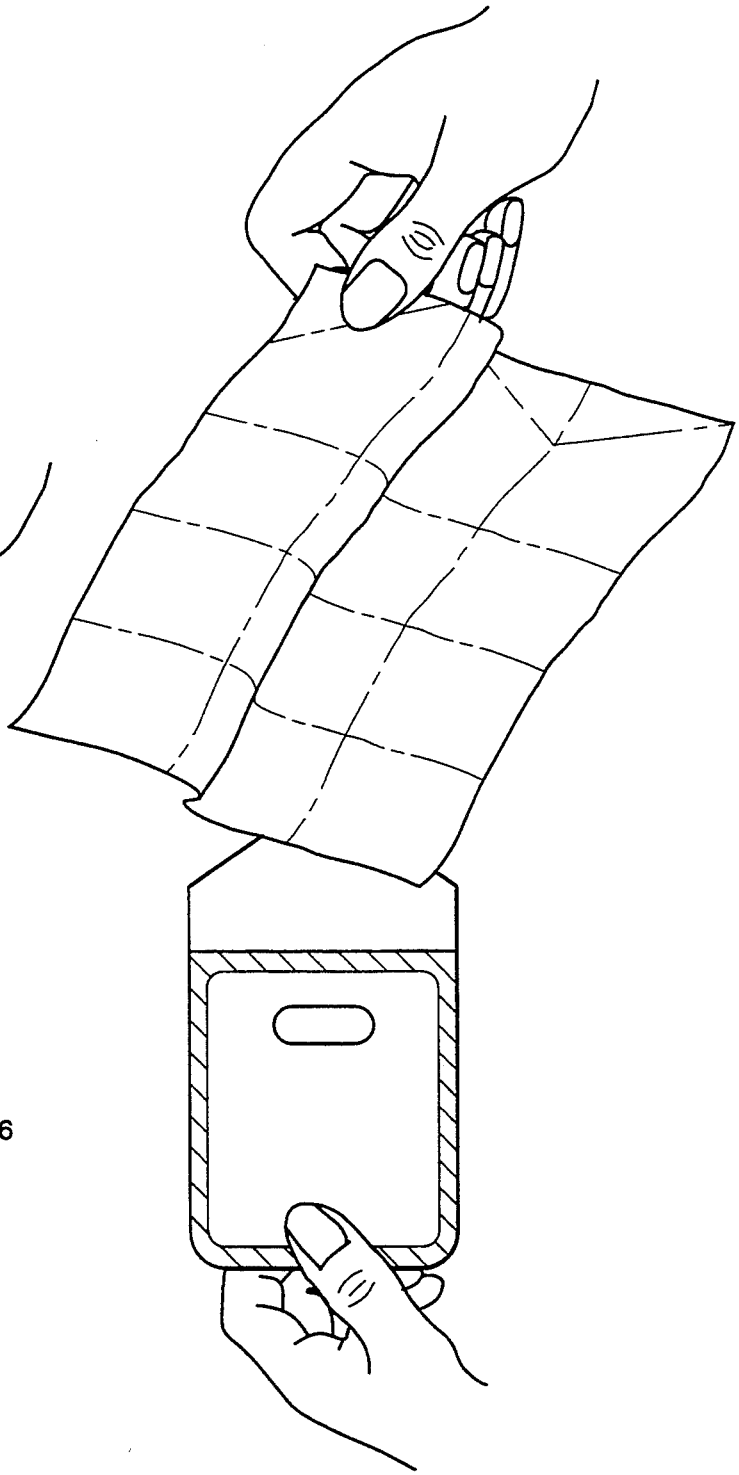

As this extraction process proceeds, more and more of the towel is withdrawn from the package and simultaneously unfolded such that the exposed portion of the towel is in a substantially unfolded state. The unfolding process culminates in the complete extraction of the towel from the package, as shown in FIG. 5D. The consumer is now holding a fully and completely unfolded towel, such that the towel is now ready for the desired use. The empty package may now be disposed of in an appropriate fashion.

A unique interaction between the folded towel and the periphery of the opening is the source of the unfolding feature of this embodiment of the present invention. The opening is preferably smaller in both directions than the folded width and folded thickness of the towel. This ensures that the towel cannot simply slide out of the package while remaining in its folded state. The periphery of the opening exerts a force on the towel in a direction which opposes the force exerted by the consumer in withdrawing the towel and serves to accomplish the unfolding of the lateral folds of the towel. Because the opening is also generally smaller than the folded width of the towel, the edges of the opening push inward on the outermost folds and edges of the folded towel as the towel passes through the opening, thus serving to cause the overlying surfaces of the towel between the longitudinal folds to separate and effectuate the unfolding of the longitudinal folds of the towel.

This interaction between the folded towel and the opening is what dictates the size and shape of the opening, as well as the manner in which the towel is folded. As stated previously, the number of folds in each direction is not critical, so long as the towel ultimately reaches a generally rectangular shape with the longitudinal folds folded first and the lateral folds folded last. As the towel passes through the opening, the lateral folds unfold first and the longitudinal folds unfold last, due to the nature of the forces applied by the opening on the towel.

The forces applied, particularly the inward forces applied to unfold and separate the longitudinal folds, must be sufficient to overcome the adhesion force between adjacent towel surfaces. This adhesion force is caused by the use of cleansing agents or other liquids to moisten the towel. The opening must therefore be sized to account for not only the dimensions of the folded towel, but also the "stickiness" of the towel in terms of the adhesion force between adjacent layers. A more detailed discussion of the adhesion force appears below.

Although the shape of this opening may range from a narrow slit to an oval to nearly circular depending upon the final dimensions of the folded towel, two dimensions of the opening will remain constant for a particular folded towel. For the purposes of this invention the term "circumference" refers to the length of the periphery of the opening, "maximum width" refers to the maximum extent of the opening in the direction parallel to the sides of the package (which represents the minor dimension of the elongated opening), and "maximum length" refers to the maximum extent of the opening in the direction parallel to the dispensing edge of the package (which represents the major dimension of the elongated opening), all regardless of the actual shape of the opening.

In order to achieve the proper unfolding of the folded towel, the opening dimensions must be related to the dimensions and adhesion properties of the folded towel. For towels and packages according to this first embodiment of the present invention, this relationship assumes the form $ML=A\times FW$, $MW=B\times SFT$, where ML is the maximum length of the opening, MW is the maximum width of the opening, FW is the folded width of the folded towel, SFT is the second folded thickness of the folded towel, and A and B are experimentally determined parameters which account for the adhesion properties and unfolding characteristics of the folded towel in its folded condition.

In a package configuration according to this embodiment of the present invention, a trial and error experimental process has revealed that the parameter A is preferably between about 0.8 and about 1.3, more preferably between about 0.9 and about 1.2, and most preferably about 1.0. Likewise, the parameter B is preferably between about 1.0 and about 3.0, more preferably between about and about 1.2, and most preferably about 1.1. It should be noted that even though the openings may typically have a maximum width which is larger than the second folded thickness of the folded towel, and may perhaps also have a maximum length which is larger than the folded width of the towel, due to the fact that the towel is being extracted from the package by pulling in a direction which lies in the plane of the package, both sides of the folded towel do contact and interact with the edges of the opening defining the maximum width.

As the adhesion force required to separate adjoining layers of the towel (discussed in greater detail below) increases, the parameters A and B tend toward the lower end of these ranges so as to result in increased force exerted inwardly on the towel. As the towel becomes stiffer and/or has a higher basis weight, and hence harder to compress inward in a direction parallel to the folded width (FW), and/or as the number of longitudinal folds increases, the parameters A and B tend toward the higher end of these ranges. Surface textures which increase resistance to sliding of towel layers with respect to each other also lead to parameters A and B which tend toward the higher end of these ranges. These relationships hold generally constant for a wide range of folded towel dimensions, although for towels which have unusually large or small folded dimensions, these ranges may need to be adjusted up or down to achieve acceptable unfolding performance.

If the opening is sized too small for a towel of given dimensions and adhesion characteristics, or if the towel surfaces adhere too strongly, one of two things is likely to occur. First, the towel may tear, leaving the consumer holding only a portion of the towel while the remainder of the towel remains folded within the package. Second, the package itself may tear, particularly in the vicinity of the opening, allowing the towel to emerge from the package while still in its folded state, or only partially unfolded. Of course, neither of these occurrences are desirable, and with proper assessment of the adhesion forces present the package can be designed appropriately.

Thus, once a towel material, cleansing agent, and folded towel dimensions are selected, these relationships can be utilized to properly size and configure an opening which will provide the unfolding feature of the present invention.

As shown in FIG. 4B, a presently preferred opening configuration is one in which the opening 152 has an elongated, generally oval shape. According to this first embodiment, regardless of the exact size or shape of the opening, the location of the opening will be generally toward one end of the front sheet, which preferably has an overall shape of a generally rectangular nature.

This location facilitates the extrication of the folded towel from the package by enabling the consumer to grasp the edge of the package farthest from the opening with one hand and exert a pulling force on the towel with the other hand. As shown in FIG. 5C, this pulling force is exerted generally in the plane of the package, rather than perpendicular to the plane of the package. The location nearer to one edge, the dispensing edge 155, maintains the planar orientation/relationship of the package and towel during the unfolding process, and increases the relative amount of package containing the towel while minimizing the empty portion of the package between the opening and the "drawing" end of the package.

The opening, therefore, is preferably located up to about one-half, more preferably up to about one-third, and most preferably up to about one-quarter of the length of the package from the dispensing edge 155. As illustrated in FIGS. 4A and 5B, this places most if not all of the folded towel between the opening 152 and the lower edge 156.

Figure 3D:
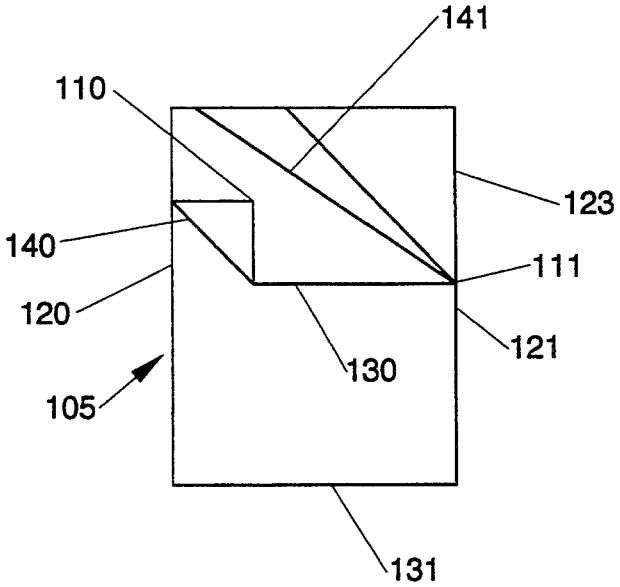
Figure 4E:
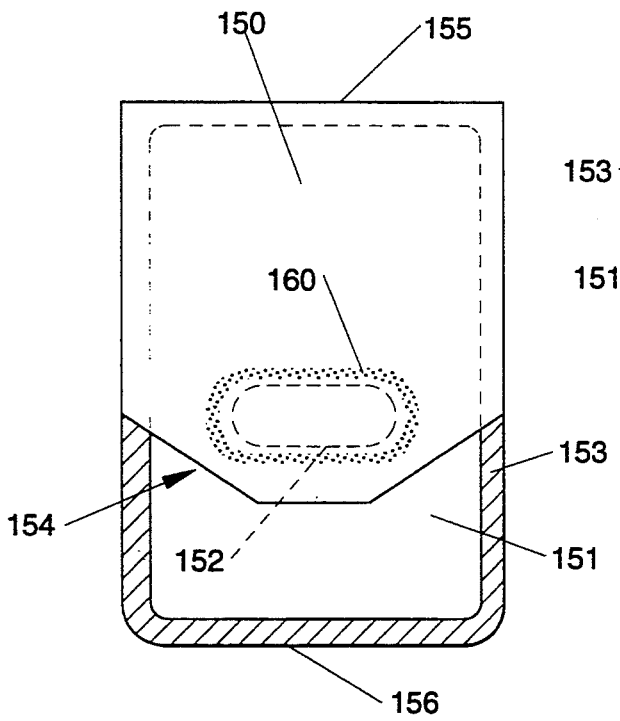
FIGS. 4E through 4H are plan views of alternative package configurations according to the first embodiment of the present invention.

For variations of the package in which the opening is more centrally located, as shown in FIG. 4E, to avoid a large portion of the package remaining unoccupied, the leading edge of the towel is preferably folded downward over the front side of the folded towel (and the free corner 110 folded oppositely to that shown in FIG. 2B) as shown in FIG. 3D such that the grasping portion 110 of the folded towel is also more centrally located and is in registry with the opening.

In an embodiment of the aforementioned type, the consumer must withdraw the folded towel by pulling the towel through the opening generally perpendicularly to the plane of the package to achieve unfolding of the towel. This necessitates restraining the package by holding two opposite edges or corners of the package while withdrawing the towel.

Various means of forming opening 152 and closure 154 are possible, all of which permit performance of the necessary interaction between the folded towel and the opening. For example, as depicted in FIG. 4B, opening 152 can comprise an orifice cut out of front sheet 151, such that the front sheet material within the dotted lines is removed entirely. The closure 154 is then formed by bonding the flap depicted in FIG. 4C over opening 152 so as to seal the package. When closure 154 is peeled away as depicted in FIG. 5B, the opening 152 is exposed for use.

Alternatively, the opening could be formed by fully perforating or partially perforating (only through the outermost layer of front sheet 151, so as to maintain package integrity), slitting, or scoring (such as by use of a laser or sharp edge) the front sheet so as to outline the opening, then bonding the closure over the outlined opening in the manner described above, and further including bonding the closure to the portion of the front sheet bounded by the outlined opening. When the closure is peeled away, the portion of the front sheet within the perforation, slitting, or scoring outline remains attached to the closure and is torn free from the remainder of the front sheet, thus exposing the opening for use.

Figure 4F:
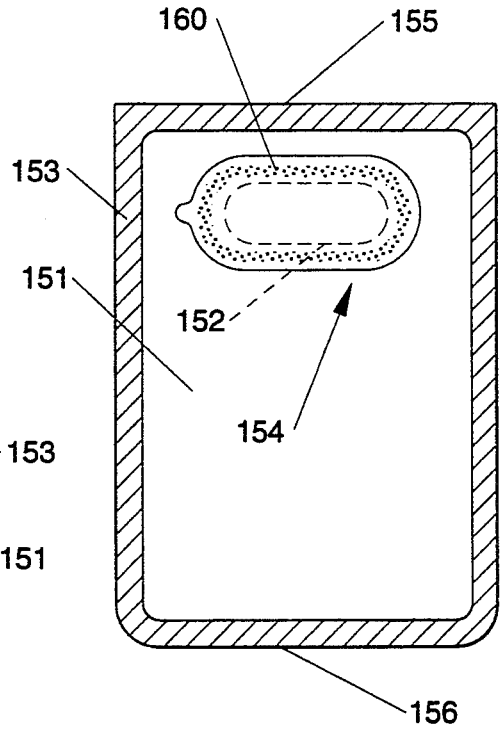

In still another variation, the back sheet 150 and front sheet 151 could be substantially the same length, and a separate removable piece of thin, flexible sheet material somewhat larger in all directions than opening 152 bonded to the front sheet around the periphery of the opening so as to constitute a closure 154, such as depicted in FIG. 4F. The opening is formed as above described, and when the closure 154 is removed from the front sheet 151, the opening is exposed for use.

Many other ways of forming the closure are possible, and all are deemed to be within the scope of the present invention.

In all circumstances where the forming of the opening constitutes a breach (or a potential breach) of the liquid-impervious nature of the front sheet, the closure must provide a liquid-tight and air-tight seal over the opening so as to prevent possible contamination and/or drying out of the folded towel prior to use. This can be accomplished by the use of adhesives applied to the underside of the closure, the surface of the front sheet around the opening, or both, and extending uninterrupted entirely around the periphery of the opening. Alternatively, a two-sided adhesive tape, preferably a high tack/low tack tape such as tape number 9415PC, manufactured by the 3M Corporation, could be utilized, again extending uninterrupted entirely around the periphery of the opening with the high tack side preferably facing the front surface of the package. Another alternative would be to use some sort of thermal bonding of the closure to the front sheet, such as described below with respect to sealing the front and back sheets together. The use of the two-sided high tack/low tack tape is a presently preferred method of affixing the closures of packages according to this embodiment of the present invention.

While with regard to single-towel packages reclosability and resealability of the closure are not critical, if the package were adapted to provide multi-towel capabilities the closure would preferably be resealable in order to protect the remaining unused towels from contamination and drying out.

As shown in FIGS. 4B–4F and 5A–5B, removable closures utilized in this first embodiment preferably incorporate some sort of protruding tab which is not firmly bonded to the outer surface of the front sheet so as to form a means for enabling the consumer to grasp the closure to initiate the removal process. This protrusion can be of any desired shape, but may preferably be a simple lateral extension of the periphery of the closure to form a rounded projection.

As shown in FIGS. 5C and 5D, it is important that when withdrawing the towel 105 from the package the consumer grasps the package in the sealed region 153 as close to the lower edge 156 as possible. If the consumer grasps the package above the sealed area 153, there is the possibility that he or she may in fact squeeze the package in the open interior region containing the folded towel, and thereby pinch the folded towel between the front and back sheets, and thus make withdrawal of the towel more difficult.

Figure 4G:
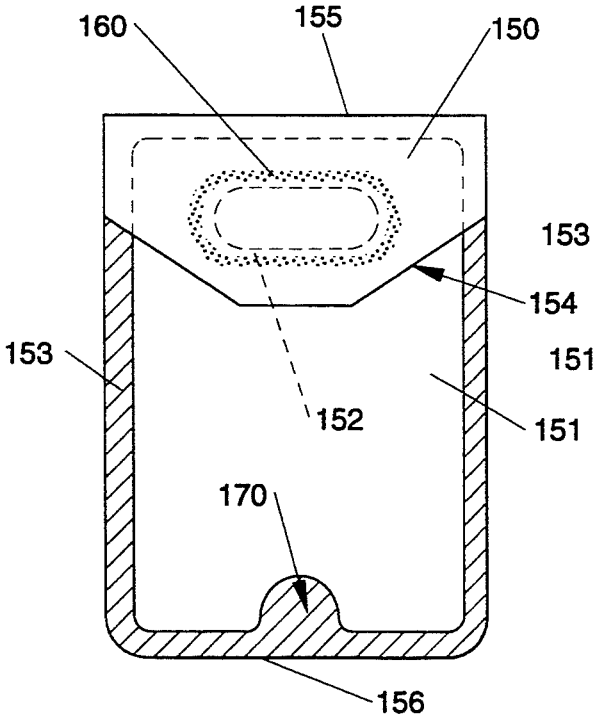
Figure 4H:
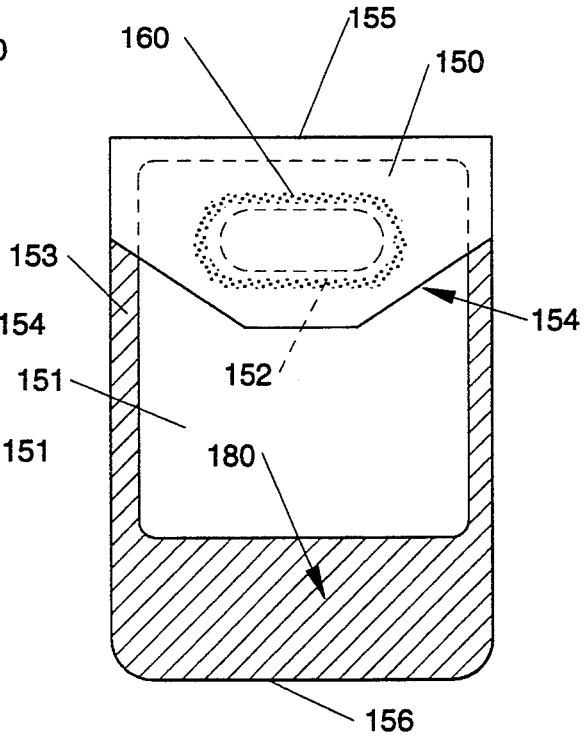

Depending upon the width of sealed area 153 at the lower edge 156, it may be desirable to provide a larger sealed region for grasping, such as shown in FIGS. 4G and 4H. This larger sealed region ensures that the towel will be located farther from the lower edge of the package, and may take the form of a single, generally central extension 170, as shown in FIG. 4G, or a generally wider sealed area 180 extending entirely across the package, as shown in FIG. 4H. The overall package length may need to be adjusted accordingly to maintain sufficient interior volume for the folded towel.

FIGS. 6 through 10D depict an improved package and folded towel according to a second embodiment of the present invention, which is a presently preferred embodiment.

Figure 6:
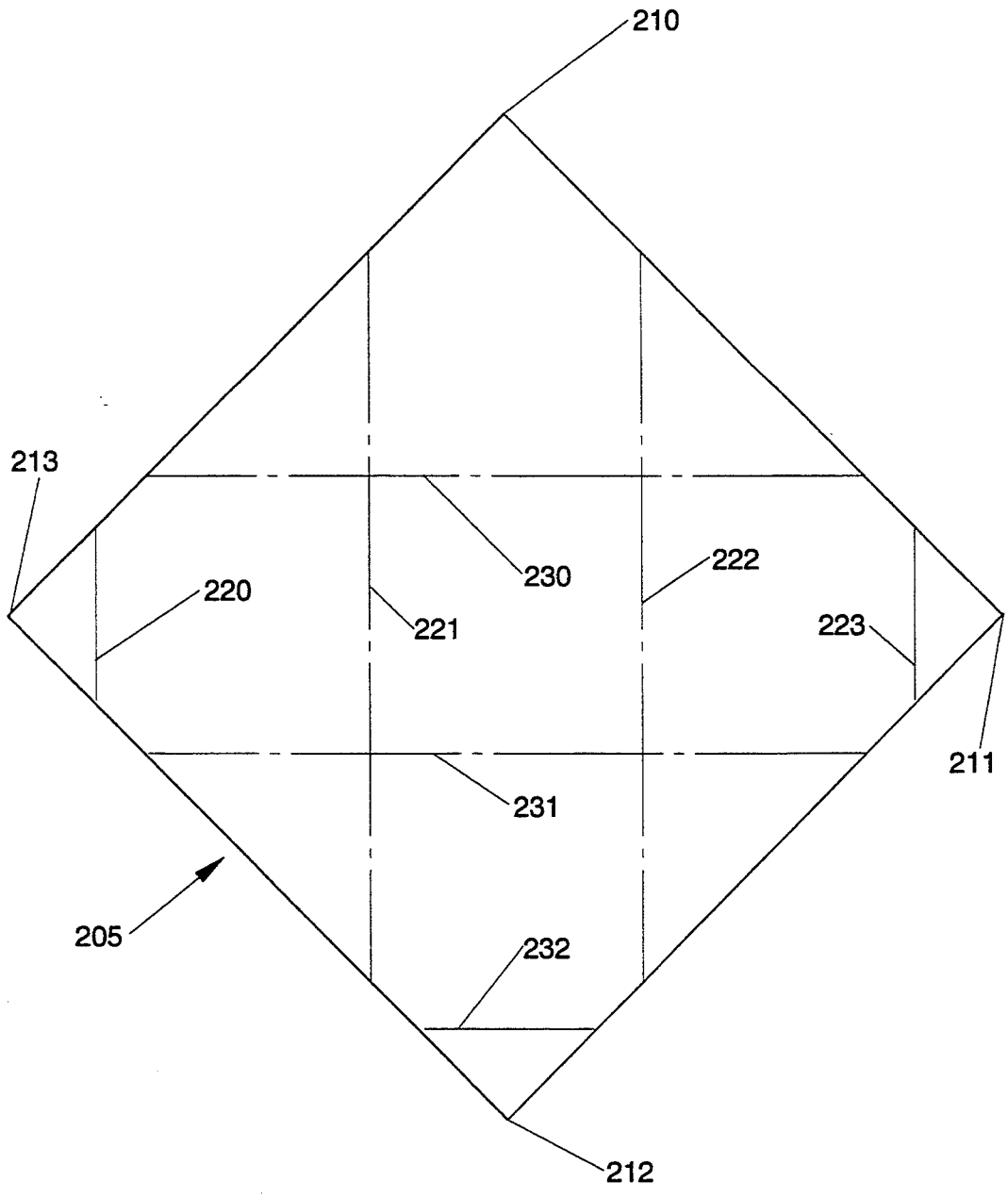
FIG. 6 is a plan view of an unfolded towel according to a second embodiment of the present invention.

FIG. 6 illustrates a towel for use with a package according to a second embodiment of the present invention, which is depicted in its unfolded state. The numeral 205 denotes the towel generally, and the numerals 210, 211, 212, and 213 are used to identify the four corners of the towel 205, which may be generally rectangular in shape in a preferred configuration.

In FIG. 6, the fold lines of towel 205 are illustrated through the use of dotted lines. In a preferred configuration, the towel has four longitudinal fold lines 220, 221, 222, and 223 parallel to an imaginary line connecting corners 210 and 212, and three lateral fold lines 230, 231, and 232 which are perpendicular to the same imaginary line. The longitudinal fold lines and lateral fold lines are thus mutually orthogonal.

Figure 7A:
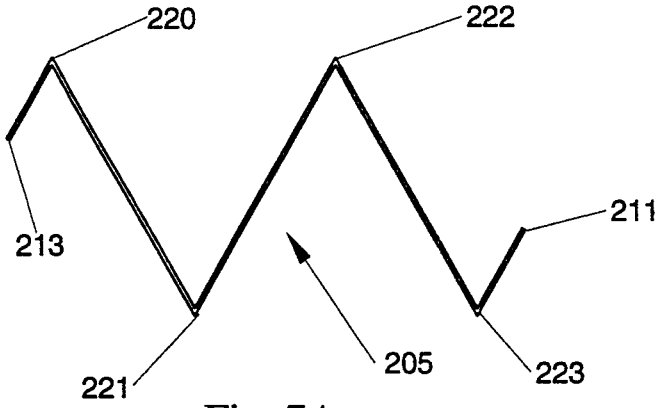
FIGS. 7A through 7C depict the steps required to fold a towel such as depicted in FIG. 6, with FIG. 7A being an elevational view, FIG. 7B being a plan view, and FIG. 7C being a perspective view.
Figure 7C:
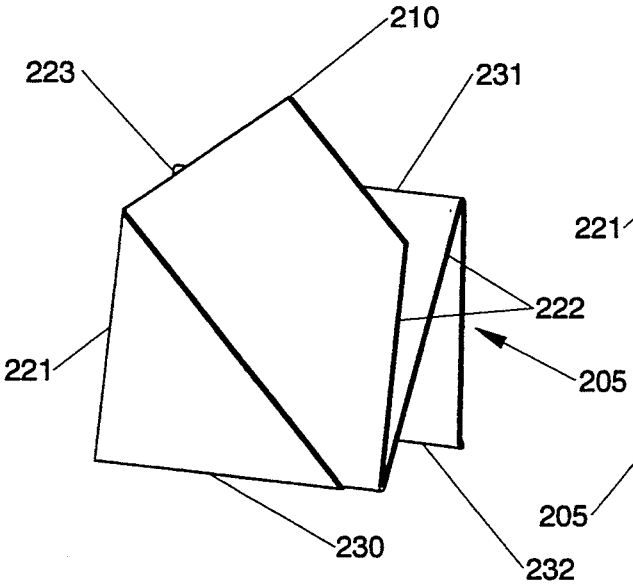
Figure 7B:
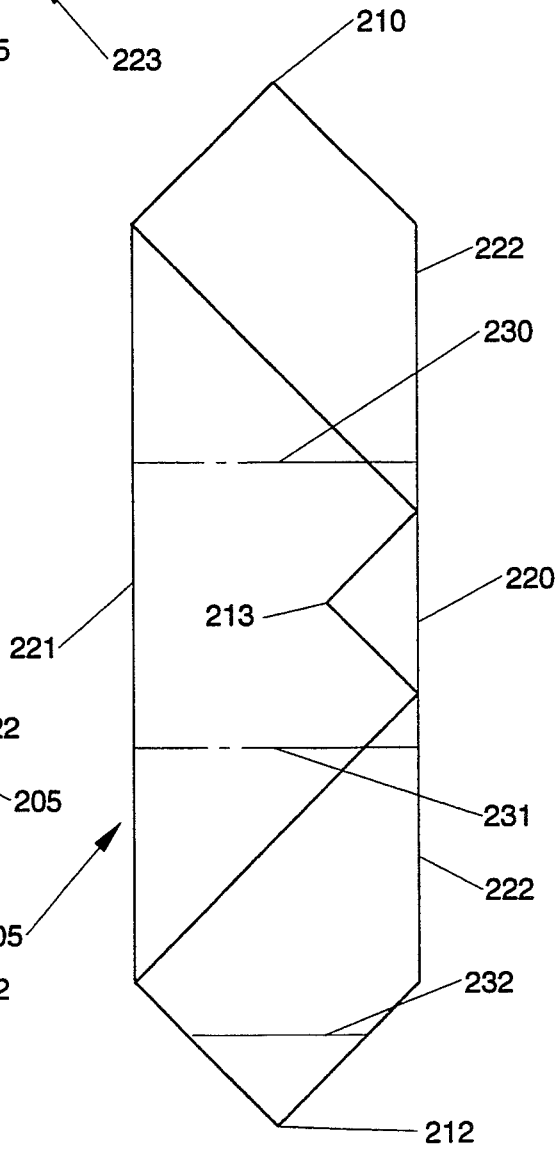

FIGS. 7A through 7C depict the folding process to fold the towel 205 depicted in FIG. 6.

FIG. 6 is a plan view looking downward on the unfolded towel 205 as it lies on a horizontal surface; hence, FIG. 7A is an elevational view looking horizontally at the towel from the direction of corner 212. In FIG. 7A, the folding of the towel 205 along the longitudinal fold lines 220–223 has been initiated.

In FIG. 7B, which returns to the same viewpoint as FIG. 6, the longitudinal folding process has been completed. Fold line 221 now overlies fold line 223, and fold line 220 now overlies fold line 222. Corner 210 has now become a free corner to form a grasping portion for the consumer to grasp to initiate the unfolding and withdrawal process, and as such will be the first portion of the towel to be withdrawn from the package. Corner 212 has now become a trailing corner, and will be the last portion of the towel to be removed from the package. Corners 211 and 213 have now been folded out of the way via fold lines 220 and 223, respectively, such that in the longitudinal direction the outer margins of the folded towel consist of only folded edges. This folding operation has defined the folded width (FW) of the folded towel, measured parallel to the lateral fold lines, and has also defined a first folded thickness (FFT), which is the thickness of the overlying folded portions of the towel.

In FIG. 7C, the towel 205 folded according to FIGS. 7A and 7B has now been accordion-folded along lateral fold lines 230–232, such that fold line 230 now overlies fold line 232. Free corner 210 extends beyond fold line 231 to ensure that the consumer will only grasp the free corner 210 rather than the entire thickness of the folded towel. This ensures the proper unfolding of the towel. This folding operation has defined the folded length (FL) of the folded towel, measured parallel to the longitudinal fold lines, and has also defined a second folded thickness (SFT), which is the thickness of the overlying laterally folded portions of the towel.

Figure 8A:
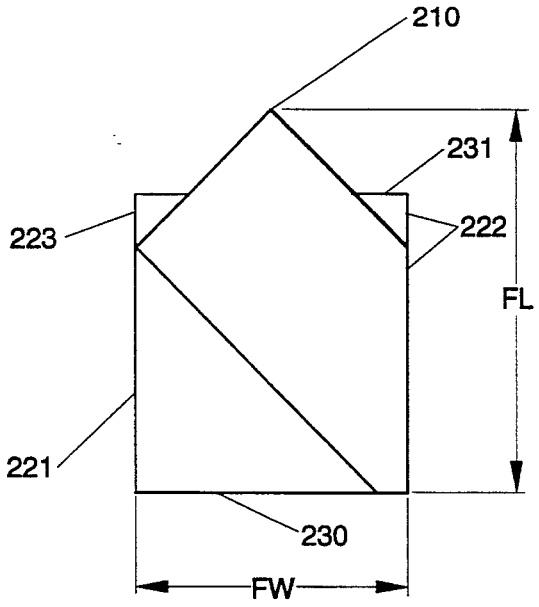
FIGS. 8A and 8B are plan views of a towel folded according to FIGS. 7A–7C, with FIG. 8A depicting a front view and FIG. 8B depicting a back view.
Figure 8B:
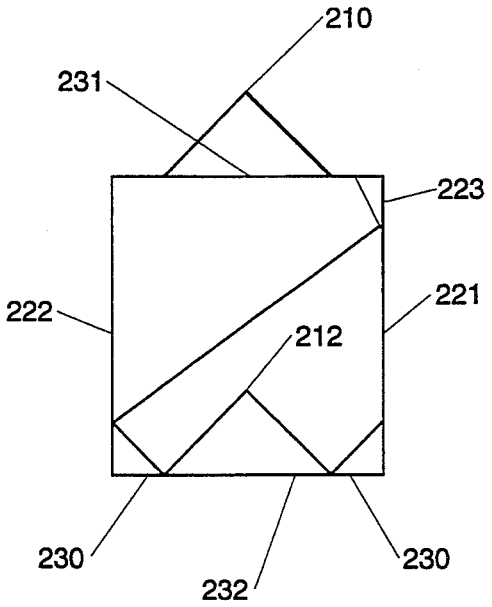

FIGS. 8A and 8B depict front and rear views, respectively, of the towel 205 after it has been folded according to the process depicted in FIGS. 7A–7C and pressed flat so as to occupy minimal space. The folded towel 205 preferably exhibits a generally rectangular outline. The distance between free corner 210 and fold line 230 (measured parallel to the longitudinal fold lines 220–223) defines the folded length (FL), and the distance between fold lines 221 and 222 (measured parallel to the lateral fold lines 230–232) defines the folded width (FW). As the longitudinal fold lines and lateral fold lines are mutually orthogonal, the folded length and folded width are also mutually orthogonal.

The various elements of the folded towel 205 which are visible in the folded state are labeled in FIGS. 8A and 8B to show their final position following the folding operation. The relative positions of these elements of the folded towel have proven to be critical to proper unfolding of the towel as described below.

Figure 8C:
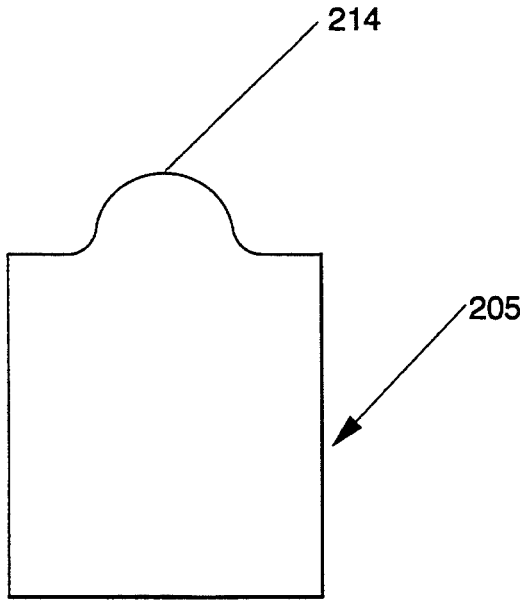
FIG. 8C is a frontal plan view of an alternative folded towel configuration suitable for use with packages according to second and third embodiments of the present invention.

While a presently preferred manner of folding the folded towel according to this second embodiment of the present invention has been set forth, there are many other ways to fold a towel so as to obtain satisfactory performance with this improved package. For example, the folding methods described with respect to FIGS. 2A–2C and FIGS. 12A–12B could be utilized, or any other similar method which incorporates a greater or lesser number of folds. In addition, the grasping portion could be formed as a projection 214 on the leading edge of the folded towel, such as shown in FIG. 8C, particularly if the towel is folded parallel to its edges as illustrated in FIGS. 2A–2C and 12A–12B rather than diagonally as illustrated in FIGS. 7A–7C.

Figure 9A:
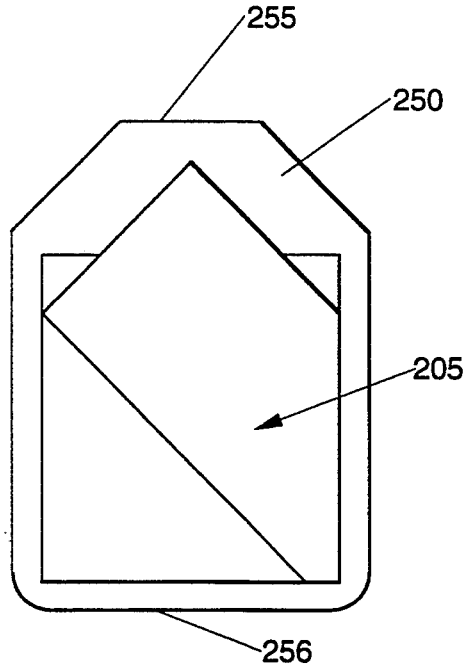
FIGS. 9A through 9C are plan views depicting the steps required to assemble an improved package according to a second embodiment of the present invention.

There are three critical aspects of the towel folding operation according to this second embodiment of the present invention. First, the towel in its finally folded state must have a generally rectangular overall shape. Second, a grasping portion must be located near the dispensing edge 255, as shown in FIG. 9A, so as to present a defined portion of the towel for the consumer to grasp and withdraw the folded towel by its leading edge. Finally, the towel must be folded longitudinally first, and then laterally, with the longitudinal and lateral folds being generally orthogonal to one another, so as to permit the lateral folds to unfold first, and then the longitudinal folds, as described below with respect to FIGS. 10A–10D.

Figure 9B:
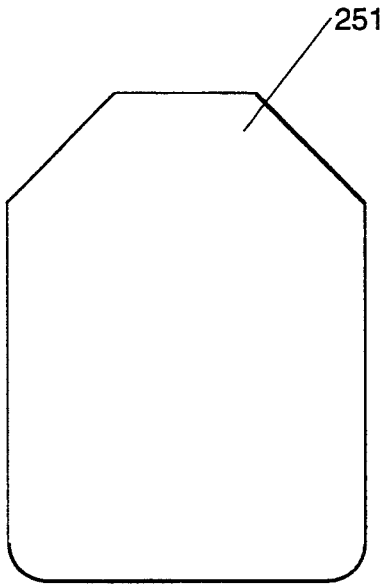
Figure 9C:
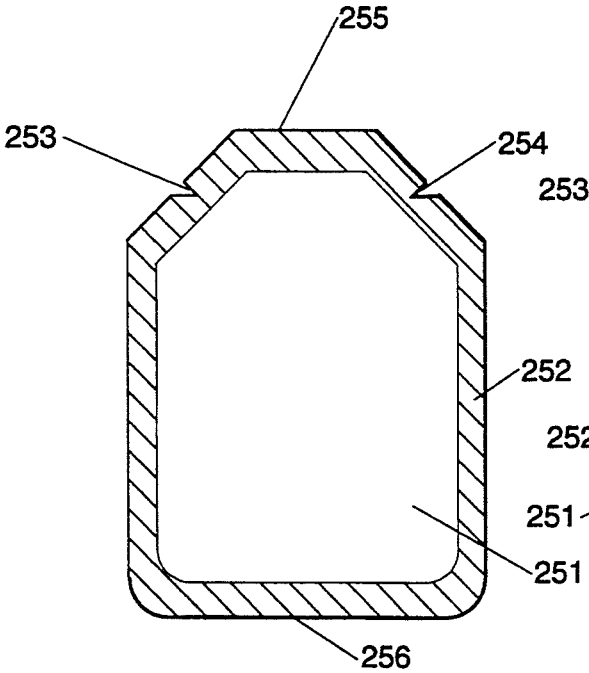

FIGS. 9A through 9C illustrate the steps required to assemble a complete package according to this second embodiment of the present invention.

In FIG. 9A, the folded towel 205 has been placed on top of a back sheet 250, which comprises a sheet of thin, flexible, and preferably liquid-impervious material. Back sheet 250 is sized so as to be marginally larger than the folded width and folded length of the folded towel 205, and is preferably shaped so as to have the edge 255 nearest to the free corner 210 shorter than the opposing edge 256.

In FIG. 9B, a front sheet 251 has been placed over the folded towel 205 and back sheet 250. Front sheet 251 also comprises a sheet of thin, flexible, and preferably liquid-impervious material, and front sheet 251 has a size and shape which generally correspond to the size and shape of the back sheet 250.

FIG. 9C depicts the completed package, after front sheet 251 and back sheet 250 have been sealed together around their peripheries as shown at 252. Near the dispensing edge 255, two notches 253 and 254 are preferably formed which extend part way through the seal 252 so as to form a means for initiating a tear line across the front and back sheets, as will be described below. The folded towel 205 is now completely contained inside an airtight and moisture-tight package, where it will remain clean and ready for use.

FIGS. 10A through 10D depict the process of opening the completed package and extracting the folded towel according to the second embodiment of the present invention.

Figure 10A:
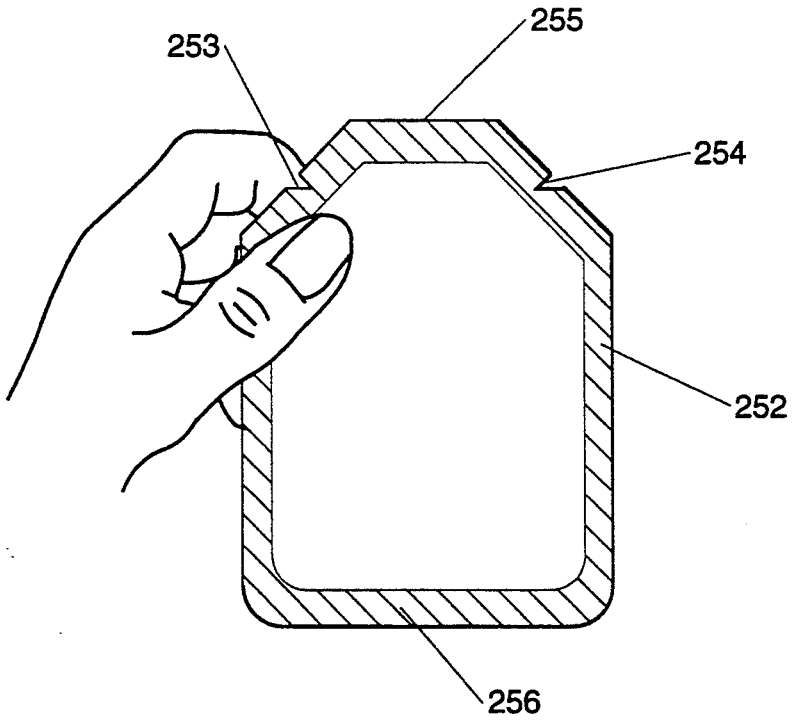
FIGS. 10A through 10D are perspective views depicting the steps required to open an improved package and remove the folded towel according to the second embodiment of the present invention.
Figure 10B:
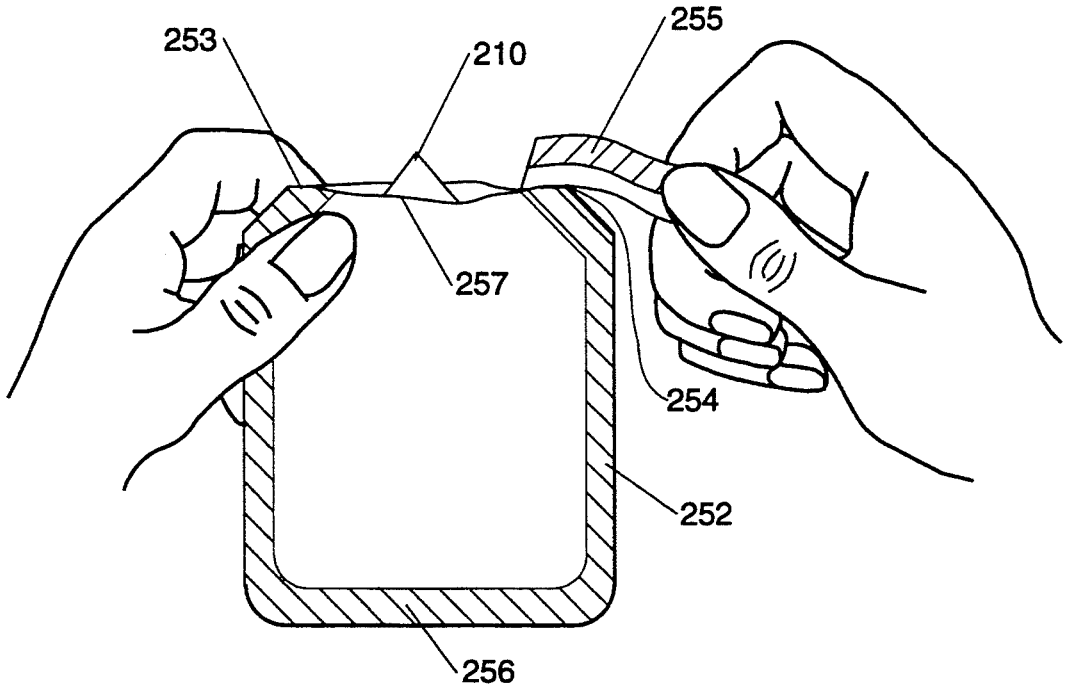

In FIG. 10A, the consumer has grasped the completed package at one side just below one of the notches, in this case 253. The consumer grasps the package with his or her other hand just above the notch 253, and by pulling his or her hands in opposite directions perpendicular to the plane of the package initiates a tear line 257 across the end of the package near dispensing edge 255 as shown in FIG. 10B. As the grain of the package material used for front sheet 251 and back sheet 250 (if the package material has a grain direction associated with it) preferably runs parallel to edge 255, the material tears across each sheet in a generally straight line from one notch 253 to the other notch 254. As also shown in FIG. 10B, this tearing operation leaves free corner 210 exposed and protruding beyond the tear line 257 so that it may be readily grasped, as described below.

Tear line 257 actually comprises a torn edge on front sheet 251 and a torn edge on back sheet 250, the two torn edges being joined to one another by the inner edges of the sealed portion 252 adjacent to the notches 253 and 254. The two torn edges free of the sealed portion 252 define the periphery of an opening which has a circumference equal to the sum of the lengths of the two torn edges, which are preferably nearly equal.

Figure 10C:
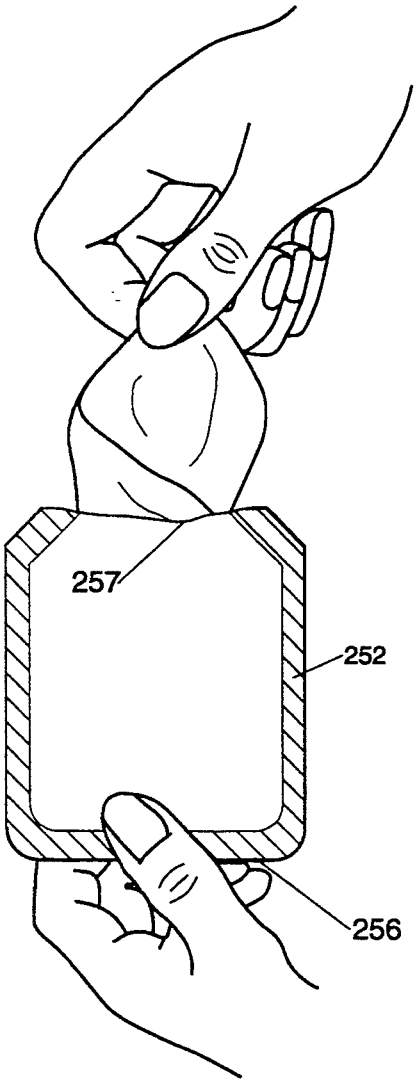

As shown in FIG. 10C, the consumer may completely tear off the upper portion of the package and discard it in an appropriate fashion, or may alternatively leave it partially attached, so long as the attachment does not extend inward beyond the inner edge of the sealed area 252 and thus diminish the size of the opening defined by tear line 257 and bounded at each end by the inner margin of sealed area 252. The consumer in FIG. 10C has now shifted one hand so as to grasp the lower edge 256 of the package with one hand and has grasped the free corner 210 with the other hand so as to begin extracting the folded towel from the package.

Figure 10D:
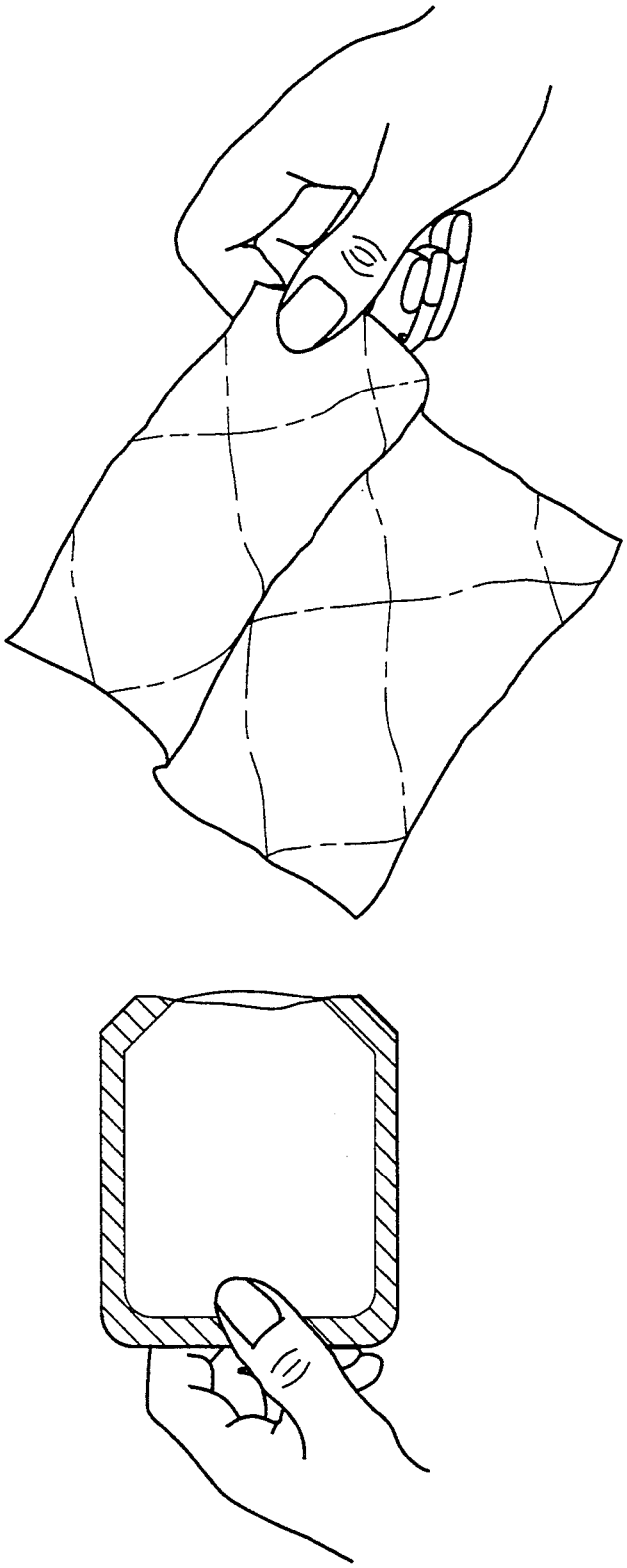

As this extraction process proceeds, more and more of the towel is withdrawn from the package and simultaneously unfolded such that the exposed portion of the towel is in a substantially unfolded state. The unfolding process culminates in the complete extraction of the towel from the package, as shown in FIG. 10D. The consumer is now holding a fully and completely unfolded towel, such that the towel is now ready for the desired use. The empty package and the torn-off portion may now be disposed of in an appropriate fashion.

A unique interaction between the folded towel and the periphery of the opening is the source of the unfolding feature of this embodiment of the present invention. The opening preferably has a length smaller than the folded width of the towel, and which is also smaller than the bottom edge of the package. During the withdrawal of the towel, the opening becomes even shorter in length as the central portions of the torn edges bow outward to accommodate the towel. This "reshaping" of the opening generates a generally elongated, somewhat oval-shaped opening analogous to the opening of the first embodiment. The size and shape of the resulting opening ensure that the towel cannot simply slide out of the package while remaining in its folded state.

The periphery of the opening exerts a force on the towel in a direction which opposes the force exerted by the consumer in withdrawing the towel and serves to accomplish the unfolding of the lateral folds of the towel. Because the opening is also generally smaller than the folded width of the towel, the "ends" of the opening push inward on the outermost folds and edges of the folded towel as the towel passes through the opening, thus serving to cause the overlying surfaces of the towel between the longitudinal folds to separate and effectuate the unfolding of the longitudinal folds of the towel.

This interaction between the folded towel and the opening is what dictates the size and shape of the opening, as well as the manner in which the towel is folded. As stated previously, the number of folds in each direction is not critical, so long as the towel ultimately reaches a generally rectangular shape with the longitudinal folds folded first and the lateral folds folded last. As the towel passes through the opening, the lateral folds unfold first and the longitudinal folds unfold last, due to the nature of the forces applied by the opening on the towel.

The forces applied, particularly the inward forces applied to unfold and separate the longitudinal folds, must be sufficient to overcome the adhesion force between adjacent towel surfaces. This adhesion force is caused by the use of cleansing agents or other liquids to moisten the towel. The opening must therefore be sized to account for not only the dimensions of the folded towel, but also the "stickiness" of the towel in terms of the adhesion force between adjacent layers. A more detailed discussion of the adhesion force appears below.

Although the shape of this opening may range from a narrow slit to an oval to nearly circular during the course of the withdrawal of the folded towel, the circumference of the opening will remain constant for a particular folded towel. For the purposes of this invention the term "circumference" refers to the length of the periphery of the opening, which can in turn be expressed as equal to twice the "maximum length", which represents the maximum extent of the opening (before beginning to withdraw the towel) in the direction parallel to the dispensing edge of the package (which represents the major dimension of the opening), and "maximum width" refers to the maximum extent of the opening in the direction perpendicular to the plane of the package (which represents the minor dimension of the elongated opening) as the opening is reshaped by the towel passing through it, all regardless of the actual shape of the opening.

In order to achieve the proper unfolding of the folded towel, the maximum length must be related to the dimensions and adhesion properties of the folded towel. For towels and packages according to this second embodiment of the present invention, this relationship assumes the form $ML=C\times FW$, where ML is the maximum length of the opening, FW is the folded width of the folded towel, and C is an experimentally determined parameter which accounts for the adhesion properties and unfolding characteristics of the folded towel in its folded condition.

In a package configuration according to this embodiment of the present invention, the maximum length of the opening is typically always less than the folded width of the folded towel, and the maximum width of the opening as it is reshaped during towel withdrawal is dictated by the performance of the towel during the withdrawal process, i.e., will seek its own size in response to the extraction of the towel. A trial and error experimental process has revealed that the parameter C is preferably less than about 1.0, more preferably between about 0.5 and about 0.9, and most preferably about 0.6. As packages made according to this embodiment of the present invention are more sensitive to towel characteristics than the other embodiments, the opening size will need to be adjusted for each particular towel type for best results.

As the adhesion force required to separate adjoining layers of the towel (discussed in greater detail below) increases, the parameter C tends toward the lower end of these ranges so as to result in increased force exerted inwardly on the towel. As the towel becomes stiffer and/or has a higher basis weight, and hence harder to compress inward in a direction parallel to the folded width (FW), and/or as the number of longitudinal folds increases, the parameter C tends toward the higher end of these ranges. Surface textures which increase resistance to sliding of towel layers with respect to each other also lead to a parameters C which tends toward the higher end of these ranges. These relationships hold generally constant for a wide range of folded towel dimensions, although for towels which have unusually large or small folded dimensions, these ranges may need to be adjusted up or down to achieve acceptable unfolding performance.

If the opening is sized too small for towel of given dimensions and adhesion characteristics, or if the towel surfaces adhere too strongly, one of two things is likely to occur. First, the towel may tear, leaving the consumer holding only a portion of the towel while the remainder of the towel remains folded within the package. Second, the package itself may tear, particularly in the vicinity of the opening, allowing the towel to emerge from the package while still in its folded state, or only partially unfolded. Of course, neither of these occurrences are desirable, and with proper assessment of the adhesion forces present the package can be designed appropriately.

Thus, once a towel material, cleansing agent, and folded towel dimensions are selected, this relationship can be utilized to properly size and configure an opening which will provide the unfolding feature of the present invention.

As shown in FIG. 9C, a presently preferred package configuration is one in which the preferably generally rectangular package tapers such that the dispensing edge is smaller than the lower edge and the remainder of the package. The critical length, the "maximum length" defined above, corresponds to the free length of the two torn edges, which are bounded at each end by the inward boundary of the bond between the front and back sides of the package.

This tapering facilitates the extrication of the folded towel from the package by providing a smooth transition from the wide interior portion of the package to the somewhat narrower opening at the dispensing edge of the package. The orientation of the dispensing edge and the overall package configuration are particularly well-suited for the withdrawing/unfolding operation. The consumer grasps the end of the package farthest from the opening with one hand and exert a pulling force on the towel with the other hand. As shown in FIG. 10C, this pulling force is exerted generally in the plane of the package, rather than perpendicular to the plane of the package. The location of the opening generally centrally at one of the shorter edges of the package maintains the planar orientation/relationship of the package and towel during the unfolding process.

Figure 9D:
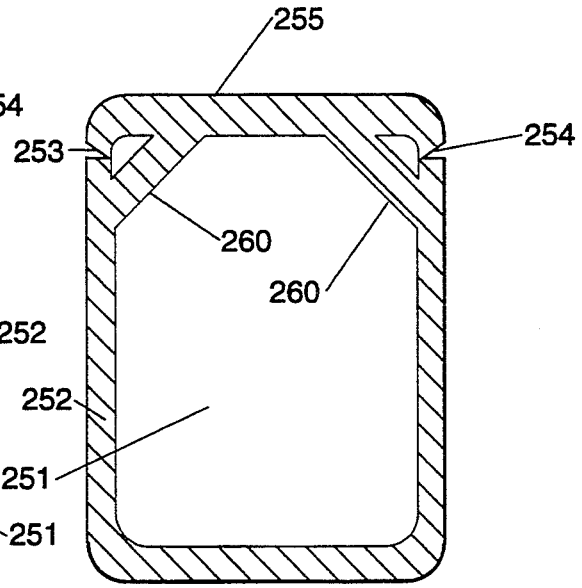
FIG. 9D is a plan view of an alternative package configuration according to the second embodiment of the present invention.

This tapering to facilitate extrication can also be accomplished by forming tapering bonded regions joining the front sheet and back sheet, as depicted in FIG. 9D and identified by the numeral 260. In this manner, the overall package shape can be rectangular or other similar shape, while the tapered bonded regions 260 properly size the opening resulting when the dispensing edge 255 is opened and provide the desirable smooth transition for the folded towel. Thus, regardless of whether or not the dispensing edge as a whole is shorter than the bottom edge, a properly sized opening which is preferably shorter than the bottom edge may be obtained upon the opening of the dispensing edge.

Many other ways of forming and properly sizing the dispensing edge are possible, and all are deemed to be within the scope of the present invention.

As shown in FIGS. 10C and 10D, it is important that when withdrawing the towel 205 from the package the consumer grasps the package in the sealed region 252 as close to the lower edge 256 as possible. If the consumer grasps the package above the sealed area 252, there is the possibility that he or she may in fact squeeze the package in the open interior region containing the folded towel, and thereby pinch the folded towel between the front and back sheets, and thus make withdrawal of the towel more difficult.

As with packages according to the first embodiment of the present invention, depending upon the width of sealed area 252 at the lower edge 256, it may be desirable to provide a larger sealed region for grasping, such as shown in FIGS. 4G and 4H. This larger sealed region ensures that the towel will be located farther from the lower edge of the package, and may take the form of a single, generally central extension 170, as shown in FIG. 4G, or a generally wider sealed area 180 extending entirely across the package, as shown in FIG. 4H. The overall package length may need to be adjusted accordingly to maintain sufficient interior volume for the folded towel.

FIGS. 11 through 15E depict an improved package and folded towel according to a third embodiment of the present invention.

Figure 11:
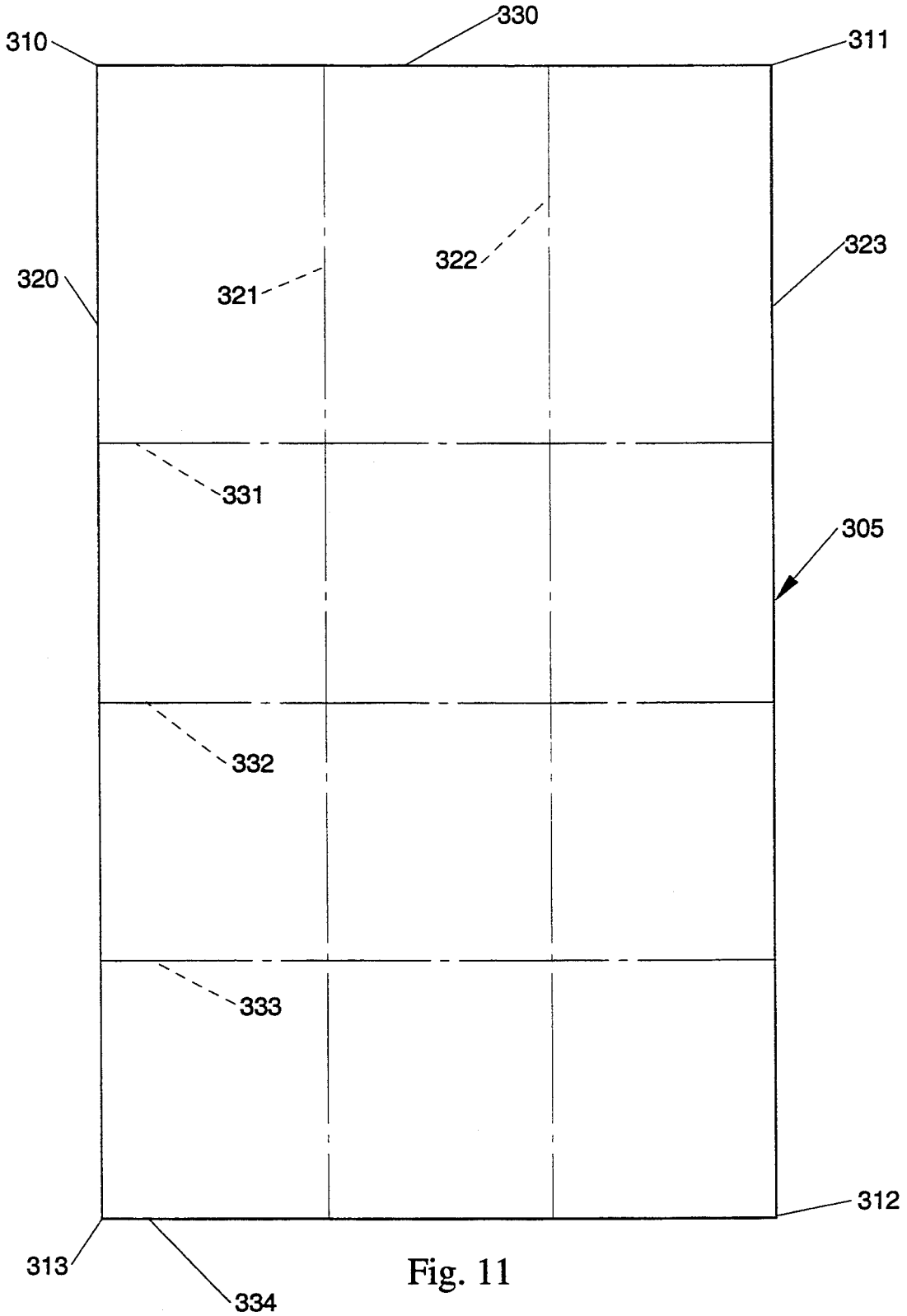
FIG. 11 is a plan view of an unfolded towel according to a third embodiment of the present invention.

FIG. 11 illustrates a towel for use with a package according to a third embodiment of the present invention, which is depicted in its unfolded state. The numeral 305 denotes the towel generally, and the numerals 310, 311, 312, and 313 are used to identify the four corners of the towel 305, which may be generally rectangular in shape in a preferred configuration. The towel 305 also has two side edges 320 and 323, a leading edge 330, and a trailing edge 334.

In FIG. 11, the fold lines of towel 305 are illustrated through the use of dotted lines. In a preferred configuration, the towel has two longitudinal fold lines 321 and 322 parallel to the side edges, and three lateral fold lines 331, 332, and 333 parallel to the leading and trailing edges. The longitudinal fold lines and lateral fold lines are thus mutually orthogonal.

Figure 12A:
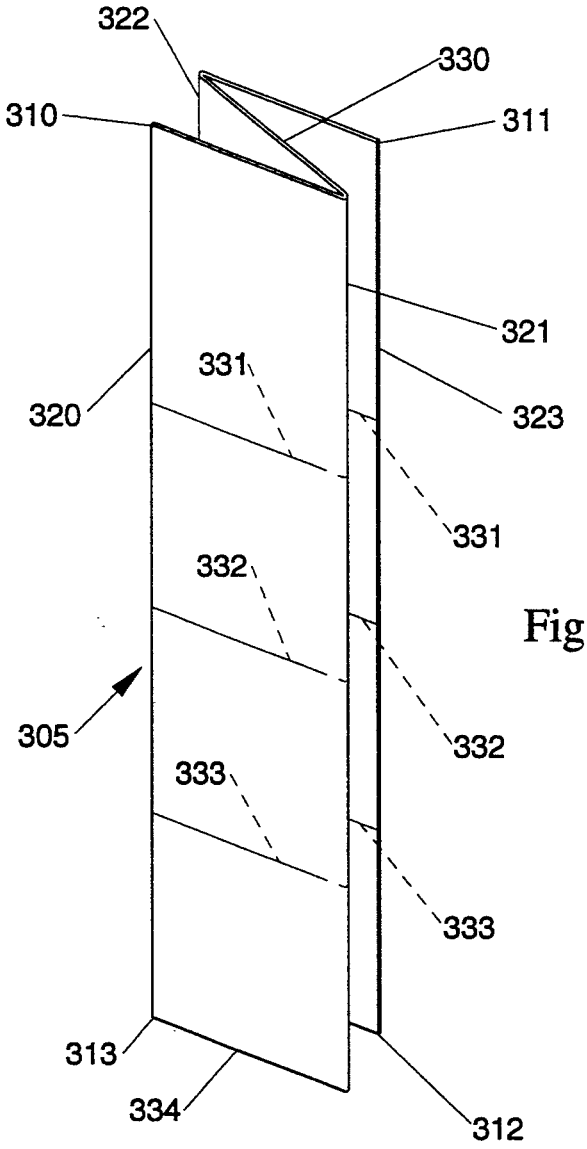
FIGS. 12A and 12B are perspective views depicting the steps required to fold a towel such as depicted in FIG. 11.
Figure 12B:
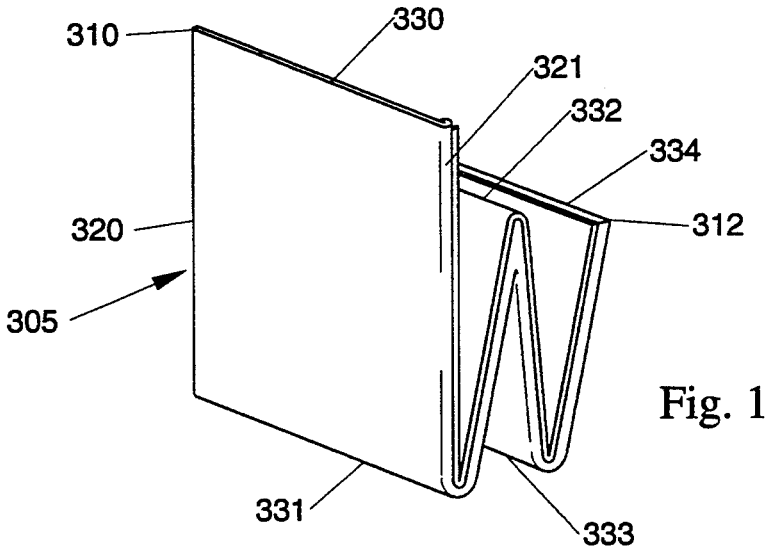

FIGS. 12A and 12B depict the folding process to fold the towel 305 depicted in FIG. 11.

In FIG. 12A, the towel 305 has been z-folded along fold lines 321 and 322 such that side edge 320 overlies fold line 322, and side edge 323 is behind fold line 321. This folding step is precisely analogous to the folding step depicted in FIG. 2A with respect to the first embodiment of the present invention. This folding operation has defined the folded width (FW) of the folded towel, measured parallel to the lateral fold lines, and has also defined a first folded thickness (FFT), which is the thickness of the overlying folded portions of the towel.

In FIG. 12B, the towel 305 folded according to FIG. 12A has now been accordion-folded along lateral fold lines 331–333 such that fold line 331 overlies fold line 333. Leading edge 330 extends beyond fold line 332 and trailing edge 334 to form a grasping portion for the consumer to grasp to initiate the unfolding and withdrawal process, and as such will be the first portion of the towel to be withdrawn from the package. Trailing edge 334 will be the last portion of the towel to be removed from the package. This folding operation has defined the folded length (FL) of the folded towel, measured parallel to the longitudinal fold lines, and has also defined a second folded thickness (SFT), which is the thickness of the overlying laterally folded portions of the towel.

Figure 13A:
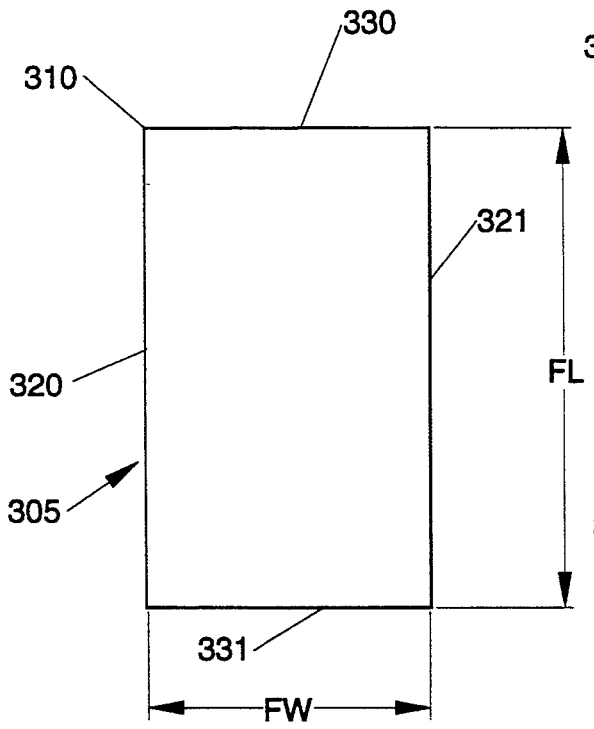
FIGS. 13A and 13B are plan views of a towel folded according to FIGS. 12A and 12B, with FIG. 13A depicting a front view and FIG. 13B depicting a back view.
Figure 13B:
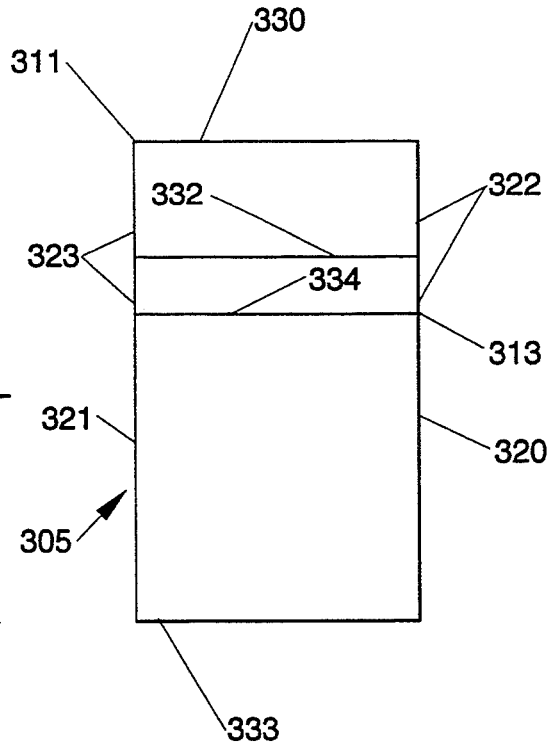

FIGS. 13A and 13B depict front and rear views, respectively, of the towel 305 after it has been folded according to the process depicted in FIGS. 12A and 12B and pressed flat so as to occupy minimal space. The folded towel 305 preferably exhibits a generally rectangular outline. The distance between leading edge 330 and fold line 331 (measured parallel to the longitudinal fold lines 321 and 322) defines the folded length (FL), and the distance between side edge 320 and fold line 321 (measured parallel to the lateral fold lines 331–333) defines the folded width (FW). As the longitudinal fold lines and lateral fold lines are mutually orthogonal, the folded length and folded width are also mutually orthogonal.

The various elements of the folded towel 305 which are visible in the folded state are labeled in FIGS. 13A and 13B to show their final position following the folding operation. The relative positions of these elements of the folded towel have proven to be critical to proper unfolding of the towel as described below.

While a presently preferred manner of folding the folded towel according to this third embodiment of the present invention has been set forth, there are many other ways to fold a towel so as to obtain satisfactory performance with this improved package. For example, the folding methods described with respect to FIGS. 2A–2C and FIGS. 7A–7C could be utilized, or any other similar method which incorporates a greater or lesser number of folds. In addition, the grasping portion could be formed as a projection on the leading edge of the folded towel, such as that identified with the numeral 214 in FIG. 8C, or in this configuration may merely constitute the leading edge of the towel, so long as it is near the dispensing edge 356 for the consumer to grasp, as shown in FIG. 14A.

There are three critical aspects of the towel folding operation according to this third embodiment of the present invention. First, the towel in its finally folded state must have a generally rectangular overall shape. Second, a grasping portion must be near the dispensing edge 356, as shown in FIG. 14A, so as to present a defined portion of the towel for the consumer to grasp and withdraw the folded towel by its leading edge. Finally, the towel must be folded longitudinally first, and then laterally, with the longitudinal and lateral folds being generally orthogonal to one another, so as to permit the lateral folds to unfold first, as described below with respect to FIGS. 15A–15E.

Figure 14A:
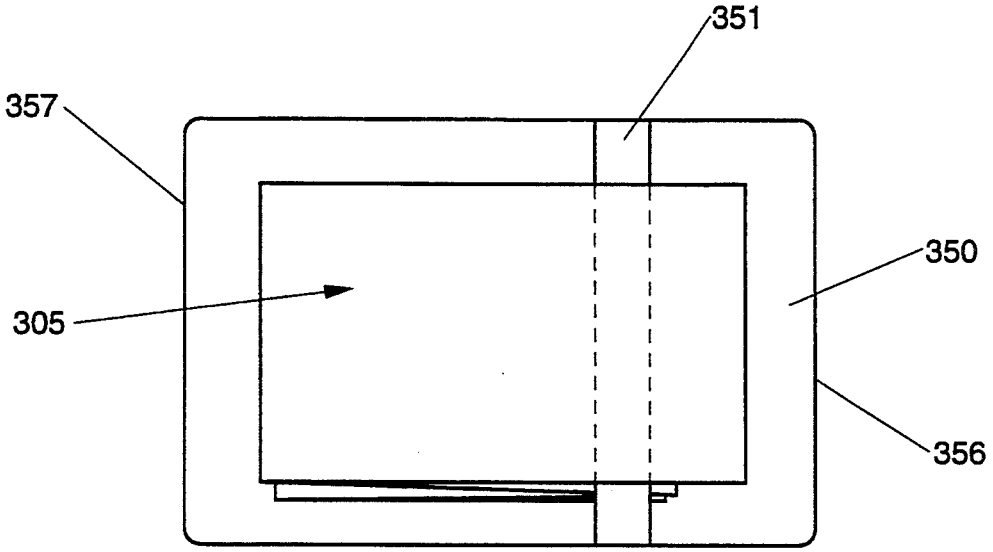
FIGS. 14A through 14C are plan views depicting the steps required to assemble an improved package according to a third embodiment of the present invention.
Figure 14B:
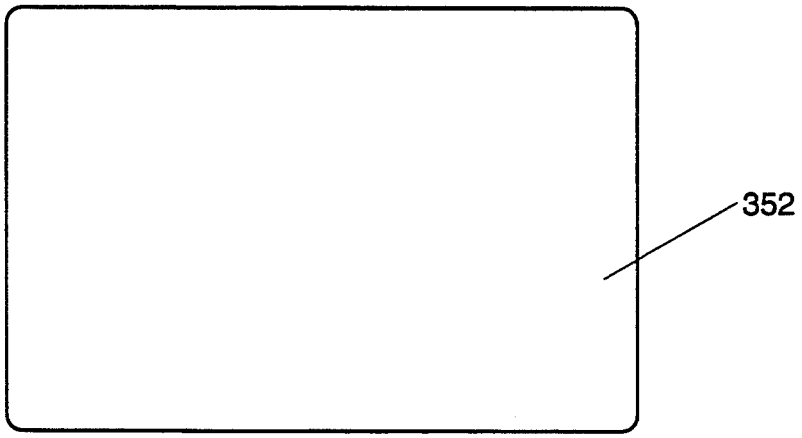
Figure 14C:
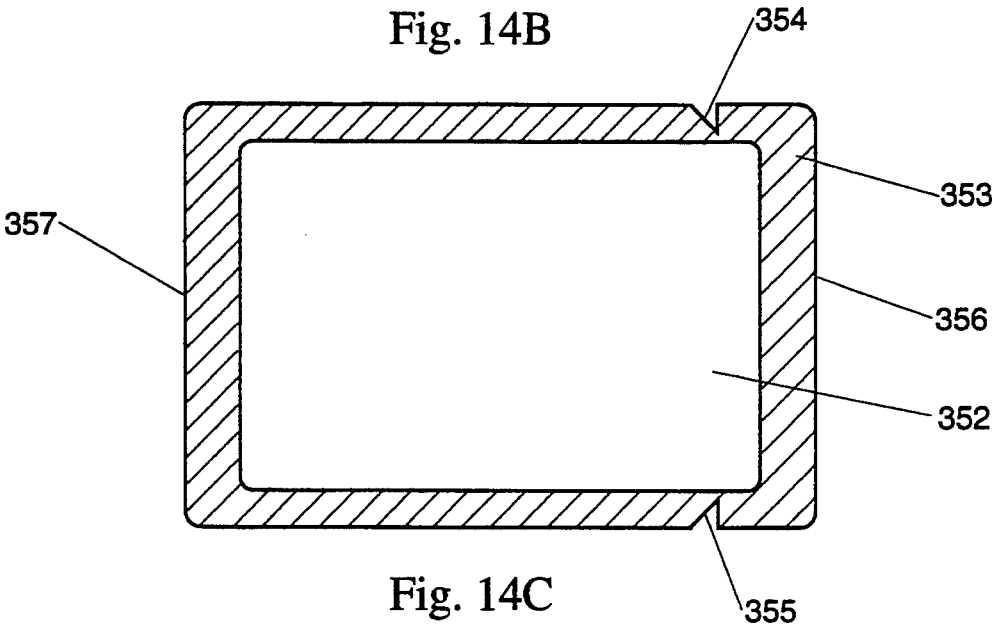

FIGS. 14A through 14C illustrate the steps required to assemble a complete package according to this third embodiment of the present invention.

In FIG. 14A, the folded towel 305 has been placed on top of a back sheet 350, which comprises a sheet of thin, flexible, and preferably liquid-impervious material. Back sheet 350 is sized so as to be marginally larger than the folded width and folded length of the folded towel 305. A flexible bar 351, comprising a strip of flexible and preferably thin material, has been placed through the folded towel 305 such that it isolates the portion of the folded towel bounded by leading edge 330 and lateral fold line 331 from the portion of the folded towel bounded by lateral fold lines 331 and 332, as well as the rest of the folded towel. Flexible bar 351 is thus parallel to the lateral fold lines 331–333, and is sized so as to match the width of back sheet 350. The importance of flexible bar 351 will be discussed below.

In FIG. 14B, a front sheet 352 has been placed over the folded towel 305 and back sheet 350. Front sheet 352 also comprises a sheet of thin, flexible, and preferably liquid-impervious material, and front sheet 352 has a size and shape which generally correspond to the size and .shape of the back sheet 350.

FIG. 14C depicts the completed package, after front sheet 352 and back sheet 350 have been sealed together as shown at 353. This seal 353 also firmly attaches the flexible bar 351 at each end to the respective margins of the package. Near the dispensing edge 356, two notches 354 and 355 are preferably formed which extend part way through the seal 353 so as to form a means for initiating a tear line across the front and back sheets, as will be described below. The folded towel 305 is now completely contained inside an airtight and moisture-tight package, where it will remain clean and ready for use.

FIGS. 15A through 15E depict the process of opening the completed package and extracting the folded towel according to the third embodiment of the present invention.

Figure 15A:
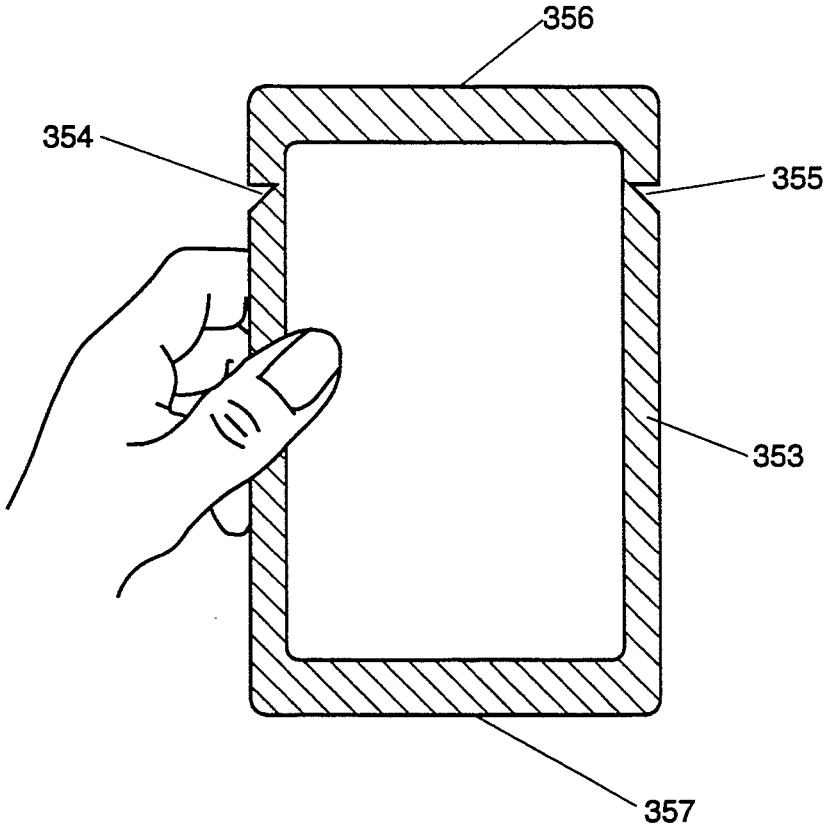
FIGS. 15A through 15E are perspective views depicting the steps required to open an improved package and remove the folded towel according to the third embodiment of the present invention.
Figure 15B:
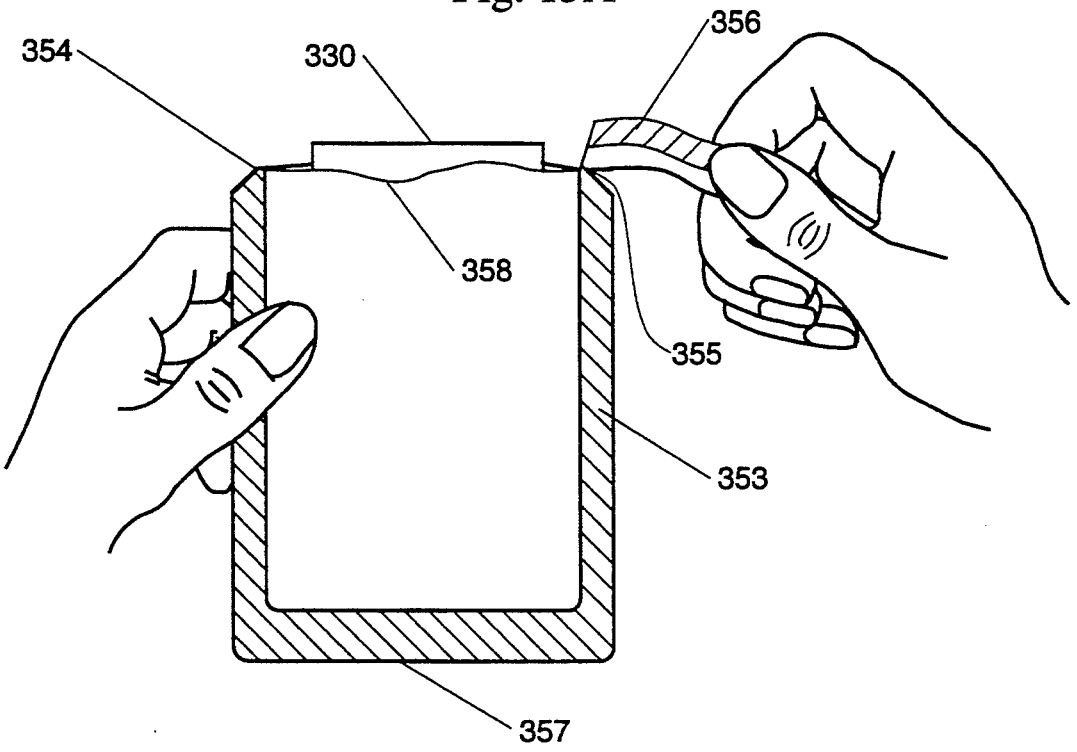

In FIG. 15A, the consumer has grasped the completed package at one side just below one of the notches, in this case 354. The consumer grasps the package with his or her other hand just above the notch 354, and by pulling his or her hands in opposite directions perpendicular to the plane of the package initiates a tear line 358 across the end of the package near dispensing edge 356 as shown in FIG. 15B. As the grain of the package material used for front sheet 352 and back sheet 350 preferably runs parallel to edge 356, the material tears across each sheet in a generally straight line from one notch 354 to the other notch 355. As also shown in FIG. 15B, this tearing operation leaves leading edge 330 exposed and protruding beyond the tear line 358 so that it may be readily grasped, as described below.

Tear line 358 actually comprises a torn edge on front sheet 352 and a torn edge on back sheet 350, the two torn edges being joined to one another by the inner edges of the sealed portion 353 adjacent to the notches 354 and 355. The two torn edges free of the sealed portion 353 define the periphery of an opening which has a circumference equal to the sum of the lengths of the two torn edges, which are preferably nearly equal.

Although the shape of this opening may change from a narrow slit to an oval to nearly circular during the course of extracting the folded towel, depending upon the quantity of towel material passing through the opening at any instant in time, the circumference of the opening remains constant throughout the withdrawal process. As such, for the purposes of this invention the term "circumference" refers to the length of the periphery of the opening, regardless of its shape at any point in time. The circumference of the opening according to this embodiment of the present invention is preferably at least as large as the "circumference" of the folded towel, which is defined as $2\times(FW+FFT)$, such that the opening itself does not provide any resistance to withdrawal of the towel.

Figure 15C:
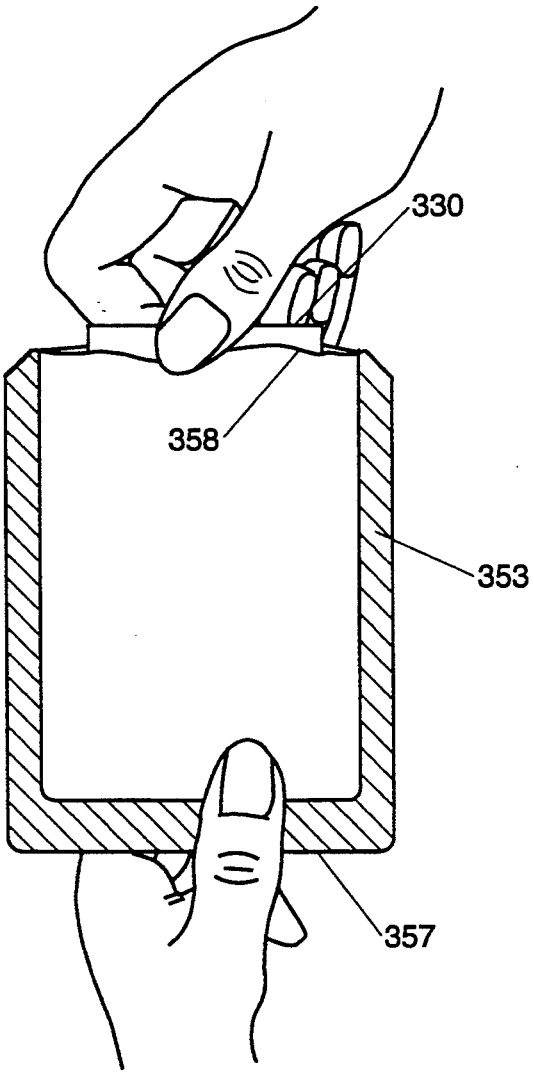

As shown in FIG. 15C, the consumer may completely tear off the upper portion of the package and discard it in an appropriate fashion, or may alternatively leave it partially attached, so long as the attachment does not extend inward beyond the inner edge of the sealed area 353 and thus diminish the size of the opening defined by tear line 358 and bounded at each end by the inner margin of sealed area 353. The consumer in FIG. 15C has now shifted one hand so as to grasp the lower edge 357 of the package with one hand and has grasped the leading edge with the other hand so as to begin extracting the folded towel from the package.

Figure 15D:
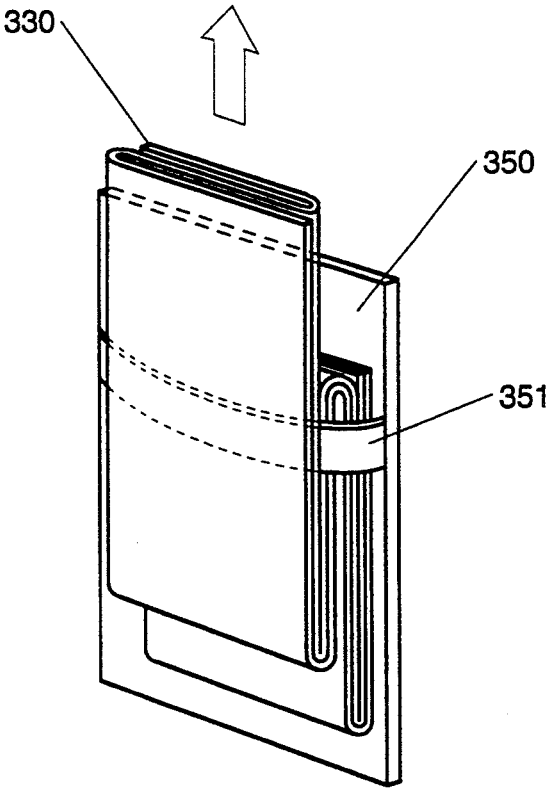

FIG. 15D illustrates the role of the flexible bar 351 in the unfolding process, with the front sheet 352 removed for clarity. As the towel is pulled from the package, the towel material is forced to pass between the flexible bar 351 and the front sheet 352, such that only one thickness of the towel at a time can pass between them. Due to the initial relationship between the folds of the towel 305 and the flexible bar 351, this ensures that all of the lateral folds 331–333 will be pulled taught and unfolded as the respective portions of the towel are aligned for passage between the flexible bar 351 and front sheet 352. As this extraction process proceeds, more and more of the towel is withdrawn from the package and simultaneously unfolded such that the exposed portion of the towel is completely unfolded in the longitudinal direction, i.e., the exposed portion of the towel is free of lateral folds 331–333.

Figure 15E:
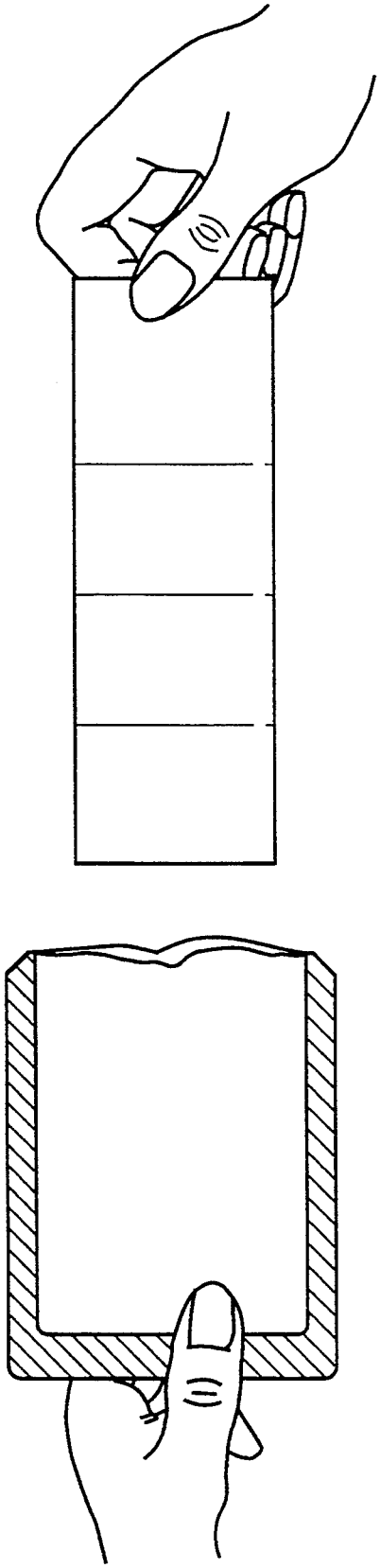

The unfolding process culminates in the complete extraction of the towel from the package, as shown in FIG. 15E. The consumer is now holding the towel by the leading edge 330, the towel having been completely unfolded in the longitudinal direction. The towel is now in the same folded state as depicted in FIG. 12A, i.e., the longitudinal folds are still folded. All the consumer needs to do in order to utilize the towel is to shake or otherwise move the towel such that the longitudinal folds fall unfolded, or manually separate the adjacent towel surfaces. The towel is then ready for the desired use. The empty package and the torn-off portion may now be disposed of in an appropriate fashion.

A unique interaction between the folded towel and the flexible bar is the source of the unfolding feature of this embodiment of the present invention. As stated above, the flexible bar is interleaved between the lateral folds of the towel so as to isolate the portion between the leading edge and the first lateral fold. Because the bar will exert a force on the towel in a direction opposing the force exerted by the consumer in withdrawing the towel, and because the bar is captured between two layers of the towel joined by this first fold, the towel cannot simply slide out of the package while remaining in its folded state. The flexible bar thus forces the towel to unfold laterally and pass between the front side of the package and the bar on its way out of the package.

This interaction between the folded towel and the opening is what dictates the size and shape of the opening, as well as the manner in which the towel is folded. As stated previously, the number of folds in each direction is not critical, so long as the towel ultimately reaches a generally rectangular shape with the longitudinal folds folded first and the lateral folds folded last. As the towel passes between the flexible bar the front side of the package on its way out through the dispensing edge, the lateral folds unfold due to the nature of the forces applied by the flexible bar on the towel.

The forces applied must be sufficient to overcome the adhesion force between adjacent towel surfaces. This adhesion force is caused by the use of cleansing agents or other liquids to moisten the towel. The flexible bar must therefore be sized to account for not only the dimensions of the folded towel, but also the "stickiness" of the towel in terms of the adhesion force between adjacent layers, because as the adhesion force becomes greater, the more likely the flexible bar is to deform and perhaps fail. A more detailed discussion of the adhesion force appears below. As the towel becomes stiffer and- /or has a higher basis weight, and hence harder to compress inward in a direction parallel to the folded width (FW), and/or as the number of longitudinal folds increases, the more likely the flexible bar is to deform and perhaps fail. Surface textures which increase resistance to sliding of towel layers with respect to each other may also lead to an increased likelihood of failure of the flexible bar.

If the flexible bar is sized too small for a towel of given dimensions and adhesion characteristics, or if the towel surfaces adhere too strongly, one of two things is likely to occur. First, the flexible bar may fail, allowing the towel to emerge from the package while still in its folded state, or only partially laterally unfolded. Second, the package itself may tear, particularly in the vicinity of the attachment of the flexible bar, allowing the towel to again emerge still at least partially laterally folded. Of course, neither of these occurrences are desirable, and with proper assessment of the adhesion forces present the package can be designed appropriately.

The flexible bar 351 according to this embodiment of the present invention is preferably of sufficient width (measured perpendicular to dispensing edge 356) as to have only minimal deformation during withdrawal of the folded towel. The width required depends on the length of the bar required to traverse the overall width of the package, the material utilized, and the rigidity of its attachment to the edges of the package. The criticality of the width is that it must be sufficient to withstand the forces exerted on it by the withdrawing of the folded towel without bowing significantly toward the dispensing edge and also so as to permit enough of its ends to be sealed and affixed to the package edges to prevent its being torn free. Conversely, using a bar which is too wide results in wasted material. For a typical package which may be approximately 3 inches (76.2 mm) wide, this width is preferably between about ¼ and about 2 inches (6.4–50.8 mm), more preferably between about ⅜ and about 1 inch (9.5–25.4 mm), and most preferably about ½ inch (12.7 mm). The material utilized for the flexible bar preferably has characteristics similar to the overall package material in terms of thickness and flexibility, and if the bar material has a grain direction associated with it, the grain preferably runs parallel to the length of the flexible bar.

The flexible bar of this third embodiment of the present invention preferably is located preferably up to about one-half, more preferably up to about one-third, and most preferably up to about one-fourth of the folded length of the folded towel from the leading edge 330 toward the first lateral fold. This orientation has been found to provide for the best unfolding performance because it allows more of the folded portion of the towel to remain unbound by the flexible bar in the lower portion of the package during the unfolding operation. It is critical, however, that the flexible bar be located sufficiently far from the leading edge 330 that the other folds of the folded towel are isolated from the portion of the folded towel between the leading edge 330 and the first lateral fold, in this case fold line 331.

As shown in FIGS. 15C and 15E, it is important that when withdrawing the towel 305 from the package the consumer grasps the package in the sealed region 353 as close to the lower edge 357 as possible. If the consumer grasps the package above the sealed area 353, there is the possibility that he or she may in fact squeeze the package in the open interior region containing the folded towel, and thereby pinch the folded towel between the front and back sheets, and thus make withdrawal of the towel more difficult.

As with packages according to the first and second embodiments of the present invention, depending upon the width of sealed area 353 at the lower edge 357, it may be desirable to provide a larger sealed region for grasping, such as shown in FIGS. 4G and 4H. This larger sealed region ensures that the towel will be located farther from the lower edge of the package, and may take the form of a single, generally central extension 170, as shown in FIG. 4G, or a generally wider sealed area 180 extending entirely across the package, as shown in FIG. 4H. The overall package length may need to be adjusted accordingly to maintain sufficient interior volume for the folded towel.

It is within the scope of the present invention that improved single-towel packages according to each of the foregoing embodiments may be modified and adapted to function as multi-towel packages while still maintaining the advantageous accessibility and unfolding features of a single-towel package. The third embodiment of FIGS. 11 through 15E is believed to be particularly well suited to such an adaptation, and FIGS. 16A through 17C depict such a variation designed for three folded towels which are detachably joined end-to-end.

Figure 16A:
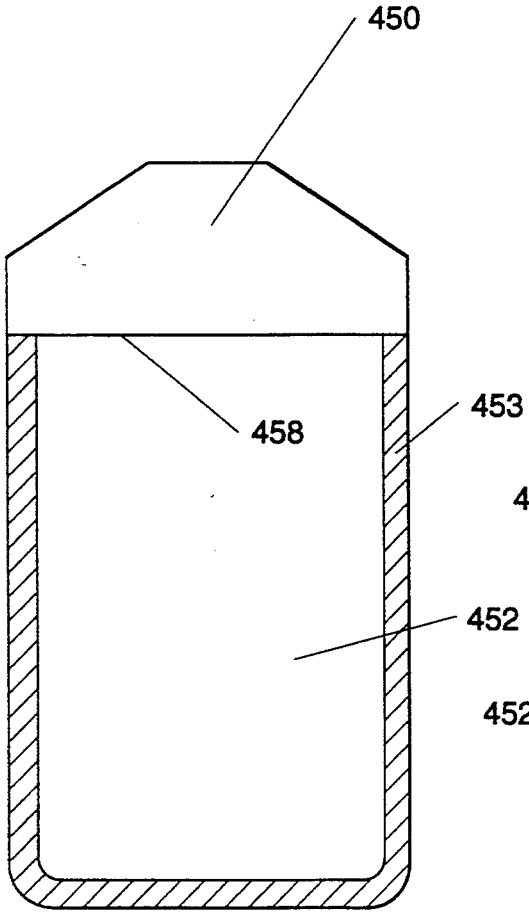
FIGS. 16A and 16B are plan views depicting two of the steps required to assemble an improved package according to a multi-towel variation of the third embodiment of the present invention.
Figure 16B:
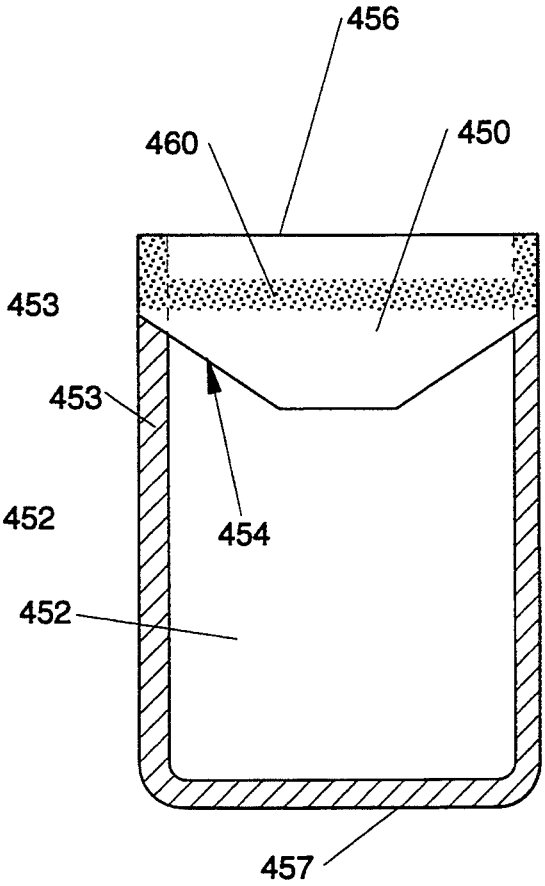

With a multi-towel package, some means of resealing the package to protect the remaining towels is often desirable (in the event all are not used at the same time). Thus, the tear-to-open dispensing edge of the single-towel version of the third embodiment could be replaced by some form of resealable closure. FIGS. 16A and 16B would replace the sealing and notching step depicted in FIG. 14C (steps depicted in FIGS. 14A and 14B would remain essentially the same), and correspond generally to the formation of the flap closure of FIGS. 4C and 4D. The difference in FIG. 16A is that the edge of front sheet 452 nearest the dispensing edge 456 is left unsealed to form an open end 458, which functions precisely the same as the tear line 358 of FIGS. 15B–15E. Front sheet 452 and back sheet 450 are joined around three sides at 453, sealing a flexible bar 451 (see FIG. 17B) between them. As shown in FIG. 16B, the unsealed portion of the back sheet 450 is then folded over the open end 458 to form a closure 454.

The stippled region 460 indicates a region of bonding between the flap closure 454 and the front sheet 452, extending entirely across the package below the open end 458 so as to form an air-tight and liquid-tight seal. This seal may be formed by any of the above-described methods, so long as it results in a reclosable and resealable seal, but the use of the two-sided tape discussed above with respect to the first embodiment is presently preferred. The dispensing edge is thus preferably releasably sealed by a resealable closure (the flap), which may be opened by a consumer to expose the open end 458 for access to the towels.

If it were desired to form a package wherein all towels would be utilized on a single occasion, or if the recloseable feature were not desired for a specific application, other means of closing the open end could be utilized. For example, the dispensing edge configuration of the second and third embodiments discussed above could be utilized to form a tear-to-open package. For permitting more consumer discretion in the pattern of usage, however, some sort of resealable closure is presently preferred, most preferably the folded over flap type of closure.

Figure 17A:
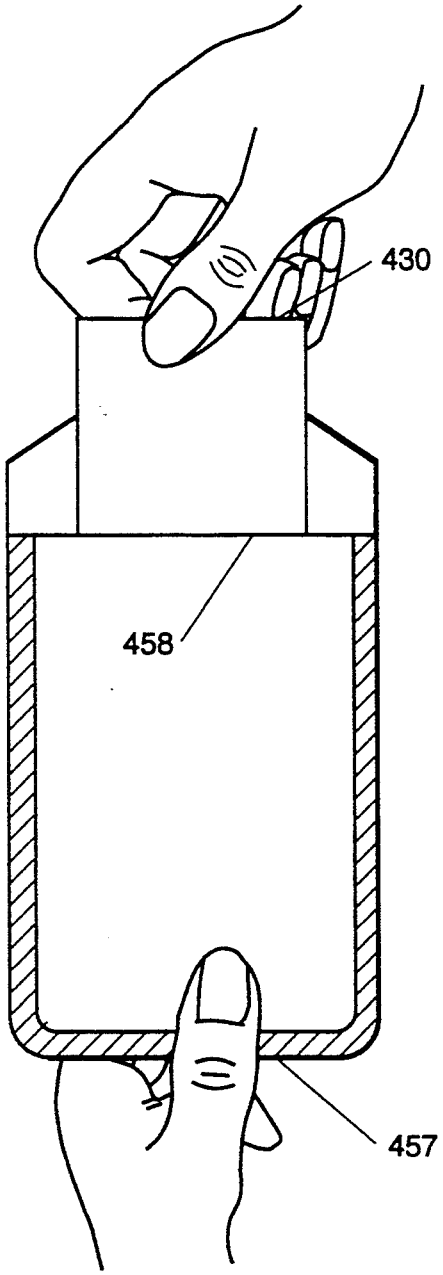
FIGS. 17A through 17C are perspective views depicting three of the steps required to open an improved package and remove the folded towels according to a multi-towel variation of the third embodiment of the present invention.
Figure 17B:
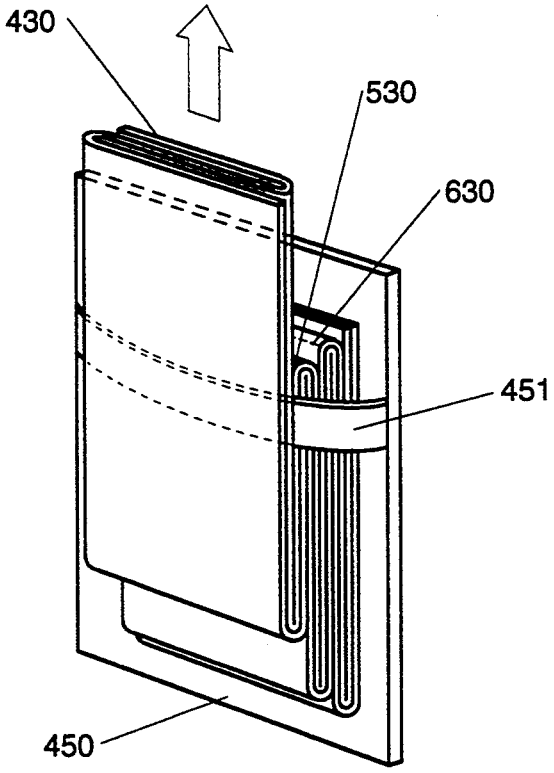
Figure 17C:
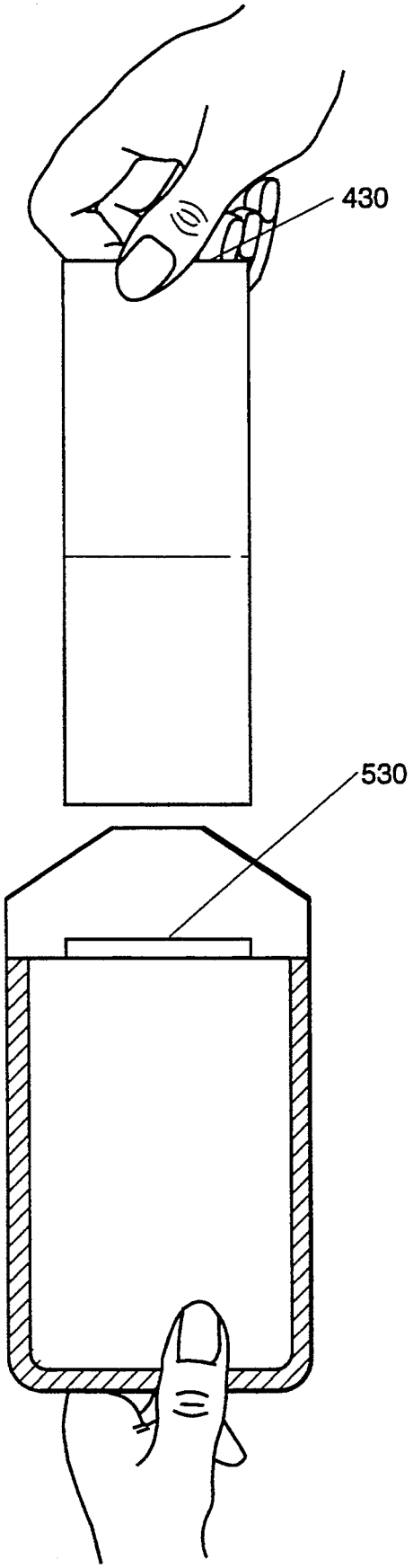

FIGS. 17A through 17C correspond to FIGS. 15C through 15E, and illustrate the withdrawing of the folded towel after the flap has been opened as depicted in FIGS. 5A and 5B. The lower edge of the package 457 (which may be enlarged, as previously described) is grasped by the consumer, and the leading edge 430 of the first towel is grasped and withdrawn through the open end 458 as previously described. The leading edge 530 of the next towel is then presented since it is attached to the trailing edge of the first towel, and the consumer then momentarily pinches the lower portion of this next towel between the front and back sheets (or otherwise restrains this sheet) so that the pulling force exerted on the extracted towel will cause the towel to tear free of the towel remaining within the package. After this next towel is withdrawn, the leading edge 630 of the next towel is presented, and this process is repeated until the supply of towels is exhausted. The flap closure may be resealed to protect the remaining towels, until such time as the last towel is withdrawn and the package disposed of in a suitable manner.

Although the towels may be folded in any suitable manner, including the folding operations previously described, it is presently preferred that the towels have fewer lateral folds, preferably only about one, such that the towels only traverse the length of the package twice and the leading and trailing edges are near the dispensing edge, as shown in FIG. 17B. The towels are detachably joined in any suitable manner such as, for example, by straight, curvilinear, or angled perforated lines, such that the trailing edge of a leading towel is joined to the leading edge of a trailing towel. While any number of towels may be utilized in such a package, the presently preferred number of towels is three to keep package size to a minimum. A stacked towel arrangement is presently preferred, although other towel arrangements may be equally suitable for use, such as side-by-side, etc.

In operation, the first towel passes behind the flexible bar and longitudinally unfolds on its way out of the package, as with the single-towel version of the third embodiment. FIG. 17C corresponds to FIG. 15E in that the towel as shown is in the same folded state as depicted in FIG. 12A, i.e., the longitudinal folds are still folded. All the consumer needs to do in order to utilize the towel is to shake or otherwise move the towel such that the longitudinal folds fall unfolded, or manually separate the adjacent towel surfaces. The towel is then ready for the desired use.

Once the first towel is entirely out of the package, and the leading edge of the next towel appears at the open end, the consumer tears off the first towel as previously described. The towels and package are then as shown in FIG. 17C, and the package can then be resealed if desired. When a subsequent towel is desired, the package can then be reopened and the leading edge of the next towel can be grasped and the towel withdrawn (as above described), and it likewise will pass behind the flexible bar and unfold longitudinally. Of course, more than one towel can be withdrawn at a time, if desired, and the towels will all follow one another behind the flexible bar and longitudinally unfold as they exit the package.

The overall shape and size of the flexible packages in each of the three embodiments of the present invention discussed above are not critical in terms of performing the unfolding operation, so long as certain common attributes are retained. For example, regardless of their exact shape the package must necessarily be somewhat larger than the final folded dimensions of the folded towel in order to entirely surround and contain the folded towel. If the package is too much larger than the folded towel, however, the package will be more bulky for the consumer to carry, and furthermore the package will be more easily distorted during the unfolding and withdrawal process. Therefore, both from a material usage standpoint and a performance standpoint, as depicted in the Drawing Figures the flexible packages of the present invention are preferably only marginally larger in all directions than the folded towels they contain, and their overall shape generally corresponds to the shape of the folded towel. Typical overall package dimensions from about 2 inches by about 3 inches ($51\times76$ mm) to about 3 inches by about 4 inches ($76\times102$ mm) have performed satisfactorily.

In addition, for those embodiments which incorporate a tearing operation to form a dispensing opening, the package must be designed to facilitate the tearing of a generally straight tear line across both front and back sheets of the package in the proper orientation with respect to the leading edge of the folded towel.

From a consumer aesthetics and transportability standpoint, it is presently preferred that all packages according to the present invention have a somewhat elongated, generally rectangular overall shape with somewhat rounded corners. Such a shape is easy for the consumer to carry, such as in a pocket or purse, and aids in the proper orientation of the package during the withdrawal and unfolding process. Other shapes may be utilized, however, such as oblong or oval shapes, square shapes, or any other desired shape.

With regard to each of the foregoing embodiments, it may be desirable to provide multi-package sets of single- or multi-towel packages suitable for more extended away-from-home use. Such sets may comprise individual packages joined at their side, top, or bottom edges to form a frangible web by some easily detachable means, such as, for example, perforated or partially slitted or scored lines. Such joints could be formed by only partially severing the packages during the sealing and cutting operations, or by forming such joints by some sort of bonding operation after the individual packages have been separated. The multi-package sets would thus lend themselves to accordion-folding, etc., to still facilitate easy transportation and concealment in a pocket or purse. Individual packages could then be removed individually as desired for use, and subsequent disposal, without affecting the sealed integrity of the remaining packages in the set.

With respect to each of the three embodiments discussed above, the unfolding advantages obtained according to the present invention may be achieved by the use of a substantially moisture-free (dry) towel, i.e., without any liquid cleansing agents or other liquids to moisten the towel. However, the towels preferably contain some quantity of a suitable cleansing agent, such as a mixture of water, polyethylene glycol, ethanol, and a perfume, and perhaps lanolin and a bacteriostat. For other uses, particularly medical uses, it may be desirable to moisten the towel with a disinfecting solution, such as alcohol. Such cleansing agents improve the effectiveness of the towel in use, but in general cause the layers of the towel to cling together when the towel is in its folded state, presenting a problem in terms of the ability of many packages to provide for unfolding of the folded towel.

Improved packages according to the present invention overcome this clinging tendency through selective applications of force to certain regions of the folded towel during the withdrawal process. While the towels may be entirely "dry", and unfold satisfactorily in such packages, or moistened with a liquid which does not impart as much "stickiness" or "clinginess" to the towel, the improved packages according to the present invention perform the unfolding process satisfactorily up to an upper limit of cleansing agent content and/or stickiness. While the quantity of the agent may vary according to the composition of the agent, and hence its "stickiness", the adhesion force quantifies a critical parameter. Other factors which affect the resistance of the towel to unfolding include the surface finish and texture of the towel, the resistance to sliding between adjacent towel layers, and the relative moisture content of the towel.

With all of the above factors combined, if too much force is required to separate the layers and unfold the folds, one of two things may be expected to occur. First, the towel itself may emerge from the package still in its folded state, or only partially unfolded, due either to the towel "roping" together while passing through an opening rather than unfolding, or due to a failure of an element of the package itself. Second, the towel may tear, leaving the consumer holding only a portion of the towel while the remainder of the towel remains folded within the package. Of course, neither of these occurrences are desirable, and with proper assessment of the adhesion forces present the package can be designed appropriately.

The towel itself can be formed of any commonly-used tissue-type paper material, or any other similar thin and flexible sheet-like material deemed suitable for use in such a package, including, for example, woven and non-woven fabric-type materials. Such materials include single- and two-ply sheets of tissue paper, having sufficient strength to avoid tearing during the withdrawing operation, especially when in a moistened condition. The basis weight, composition, and texture of the towel can be tailored so as to achieve the desired durability, feel, and cleansing ability. The overall dimensions of the towel can be selected as appropriate to accomplish the intended tasks, with the folding operation reducing the size of the towel to the desired folded dimensions. Two-ply paper towels with basis weights (per ply) of about 0.0087 $lb/ft^2$ (0.0043 $g/cm^2$) and single-ply paper towels with basis weights of about 0.0082 $lb/ft^2$ (0.0040 $g/cm^2$) have performed well, and towel dimensions of from about 3 inches by about 5 inches (76×127 mm) to about 6 inches by about 10 inches (152×254 mm) have been used successfully.

Towels suitable for use with packages according to any particular embodiment of the present invention may be folded with the fold lines parallel to the respective edges of the towel (such as depicted in FIGS. 1 and 11, for example), or non-parallel to the respective edges of the towel (such as depicted in FIG. 6, for example), so long as the longitudinal and lateral folds are generally orthogonal to one another, as described above.

The thin, flexible, and substantially liquid-impervious material utilized for the package can be any suitable single or multiple layer sheet material. Commonly used materials include metallic foils, plastic films, or treated paper products. Suitable materials include high density polyethylene, polyethylene-based copolymers, polyesters (PET, PETG), polypropylene, nylon, and a paper/-foil/low density polyethylene laminate utilized with the paper side toward the outside of the package, and a nylon/polyethylene/aluminum foil/linear low density polyethylene laminate utilized with the nylon side toward the outside of the package. One presently preferred material for packages according to the third embodiment of the present invention is the nylon/-polyethylene/aluminum foil/linear low density polyethylene laminate, while for the first and second embodiments the presently preferred material is the paper/foil/low density polyethylene laminate. The material utilized must have sufficient strength and rigidity to maintain its shape and avoid tearing during the unfolding process.

Such materials may also be utilized for the closures of the first embodiment and the flexible bar of the third embodiment. The material utilized for the flexible bar, however, need not be liquid-impervious so long as it does not deteriorate when in contact with a folded towel moistened with .a cleansing agent or other liquid. The flexible bar may even be fabricated from a thin, flexible line or cord material, such as a synthetic (nylon) monofilament line, although to provide maximum attachment area within the edge seals a sheet-like material is presently preferred.

For package configurations which utilize a tearing process to open the package and create a dispensing opening, if the package material has a grain direction associated with it, the grain direction preferably runs parallel to the direction of the tear so as to facilitate a generally straight tear line across the package. If there is no tearing operation associated with the opening of a particular package configuration, the grain direction is not critical. If the material utilized for the flexible bar of the third embodiment has a grain direction, the grain direction preferably runs across the package along the length of the flexible bar so as to afford maximum strength and resistance to tearing of the bar.

The edges of the front and back sheets of packages according to all embodiments of the present invention are preferably joined in a manner which provides a substantially liquid-tight and air-tight seal. This seal, in combination with the substantially liquid-impervious sheet material and closure (if applicable), defines a substantially air-tight and liquid-tight package for containing the folded towel. This in turn protects the folded towel from contamination and also prevents any cleansing agent from evaporating or leaking out of the package, thus keeping the towel in a condition suitable for use.

This seal may be formed by a variety of acceptable methods, including crimping, clamping, taping, bonding with various adhesives, and thermal bonding. The presently preferred method of sealing the periphery of the front and back sheets is thermal bonding. The term "thermal bonding", sometimes called "heat sealing", may include a number of methods of generating and applying heat to the members to be joined. With heat sealing, the flexible sheet material is heated sufficiently to melt at least the inner surface of each sheet to its melting point, then holding the inner surfaces in contact until the material cools and forms a bond. Possible methods which are well known include heated jaw sealing, hot air sealing, hot wire sealing, ultrasonic sealing, and impulse sealing, with the impulse sealing process being presently preferred.

The width of the seals, i.e., how far inward they extend from the periphery of the front and back sheets, however they are formed, is not critical so long as sufficient seal width is provided to maintain a durable seal. Seals which are too narrow may be prone to rupture during transport of the package prior to use, particularly in a purse or pocket environment.

For ease of manufacture, it is preferable to form the heat seals, cut the front and back sheets from larger sheets, and form the tear-initiating notches (if applicable) all at the same time, although such steps can be accomplished separately. Where such notches are formed so as to extend part way through the heat seals, it is critical that the innermost portion of the heat seal remain intact so as not to lose the liquid-tight and air-tight integrity of the package.

With respect to the third embodiment of the present invention, wherein the flexible bar is joined to the side edges of the package by the seals, it is critical that the seals firmly retain the ends of the flexible bar to withstand the forces exerted upon the bar during the withdrawal process. As such, it is preferable to have the ends of the flexible bar extend entirely through the seals and terminate approximately at the outer periphery of the front and back sheets so as to afford maximum contact area within the seal. If heat sealing is the method of sealing selected, the flexible material utilized for the flexible bar must be appropriate for the sealing operation, i.e., capable of fusing to the inner surfaces of both the front and back sheets.

There are several possible ways to facilitate the tearing open of the dispensing edges of packages formed according to the second and third embodiments of the present invention. The front and back sheets could be partially scored, slitted, or perforated along the proposed tear line, but in doing so the risk of losing the liquid-tight and air-tight integrity of the front and back sheets necessitates careful control over the depth of the scoring, slitting, or perforation. The presently preferred method, however, of facilitating opening of the packages of the second and third embodiments is to provide opposing notches in the side edges of the packages near the dispensing edge, as depicted in the Drawing Figures. The notches provide a region of stress concentration which ensures that the tearing of the front and back sheets will begin at the point of the notch and propagate across the package. Orientation of the grain of the package material (if it has a grain direction) parallel to the line of the desired tearing helps to ensure that the propagation of the tear lines will be generally straight across the package from one notch to the other.

It will be apparent to one skilled in the art that many variations of the present invention are possible. For example, the packages may differ in size, thickness, and/or shape from those disclosed above. Different materials may also be utilized, as well as different manufacturing techniques. Furthermore, depending on the physical properties of the materials used to form the packages and folded towels, and their methods of manufacture, in order to obtain best results it may be necessary to vary the dimensions and proportions from those discussed above. All such modifications and variations are within the scope and intent of the appended claims.

What is claimed is:

1. A flexible package for dispensing a folded sheet, said package comprising:

(a) at least one folded sheet, said sheet being first folded longitudinally to define a predetermined folded width and a first predetermined folded thickness and then folded laterally to define a predetermined folded length and a second predetermined folded thickness such that said sheet has longitudinal folds generally parallel to its length and lateral folds generally parallel to its width, said longitudinal folds and said lateral folds being generally orthogonal to one another, said second folded thickness being greater than said first folded thickness, said sheet further having a grasping portion for grasping by a consumer, said grasping portion extending lengthwise beyond a remainder of said sheet;

(b) a package formed of a thin, flexible material, said package entirely surrounding and containing said sheet, said package further having a front side and a back side, said package further having two opposing side edges, a bottom edge, and a dispensing edge opposing said bottom edge, each of said edges joining said front side and said back side, said dispensing edge being adapted to be opened by a consumer for access to said sheet, said dispensing edge and said grasping portion of said sheet being adjacent to one another; and (c) said package further comprising a flexible bar formed of a flexible material, said flexible bar being disposed inside said package between said front side and said back side, said flexible bar being interleaved between said lateral folds of said sheet such that a portion of said sheet between said grasping portion and a first lateral fold is on an opposite side of said flexible bar from said remainder of said sheet, said flexible bar having a width which is smaller than said folded length, said flexible bar further having a length sufficient to fully extend from one of said side edges to the other of said side edges, said flexible bar being located up to about one-half of said folded length from said grasping portion toward said first lateral fold, and said flexible bar being firmly affixed to said side edges;

whereby when said consumer opens said dispensing edge said grasping portion of said sheet is presented for grasping, and whereby upon grasping said grasping portion and withdrawing said sheet from said package through said dispensing edge, said flexible bar automatically causes said lateral folds of said sheet to substantially unfold.

2. The flexible package of claim 1, wherein said thin, flexible material is substantially liquid impervious.

3. The flexible package of claim 2, wherein said edges join said front side and said back side together with a substantially liquid-tight and air-tight seal.

4. The flexible package of claim 3, wherein said seal is formed by thermally bonding said front side and said back side together.

5. The flexible package of claim 4, wherein said side edges are provided with opposed notches near said dispensing edge to facilitate opening by said consumer.

6. The flexible package of claim 5, wherein said flexible bar is located up to about one-fourth of said folded length from said grasping portion toward said first lateral fold.

7. The flexible package of claim 6, wherein said sheet is moistened with a cleansing agent.

8. The flexible package of claim 6, wherein said sheet is substantially free of moisture.

9. The flexible package of claim 6, wherein said flexible bar is formed of a thin, flexible sheet material.

10. The flexible package of claim 6, wherein said flexible bar is formed of a thin, flexible cord material.

11. A flexible package for dispensing folded sheets, said package comprising:

(a) a first folded sheet, said first sheet being first folded longitudinally to define a predetermined folded width and then folded laterally to define a predetermined folded length, such that said first sheet has longitudinal folds generally parallel to its length and at least one lateral fold generally parallel to its width, said longitudinal folds and said lateral fold being generally orthogonal to one another, said first sheet further having a grasping portion for grasping by a consumer and a trailing edge, said grasping portion extending lengthwise beyond a remainder of said first sheet;

(b) at least one additional folded sheet, said additional sheet being first folded longitudinally to a folded width substantially equal to said folded width of said first sheet and then folded laterally to a folded length substantially equal to said folded length of said first sheet, such that said additional sheet has longitudinal folds generally parallel to its length and at least one lateral fold generally parallel to its width, said longitudinal folds and said lateral fold being generally orthogonal to one another, said additional sheet further having a grasping portion for grasping by a consumer and a trailing edge, said grasping portion of said additional sheet being detachably joined to said trailing edge of said first sheet;

(c) a package formed of a thin, flexible material, said package entirely surrounding and containing said sheets, said package further having a front side and a back side, said package further having two opposing side edges, a bottom edge, and a dispensing edge opposing said bottom edge, each of said edges joining said front side and said back side, said dispensing edge being adapted to be opened by a consumer to form an open end for access to said sheets, said dispensing edge and said grasping portion of said first sheet being adjacent to one another; and (d) said package further comprising a flexible bar formed of a flexible material, said flexible bar being disposed inside said package between said front side and said back side, said flexible bar being interleaved between portions of said first sheet such that a portion of said first sheet between said grasping portion and said lateral fold is on an opposite side of said flexible bar from said remainder of said first sheet and said additional sheet, said flexible bar having a width which is smaller than said folded lengths of said sheets, said flexible bar further having a length sufficient to fully extend from one of said side edges to the other of said side edges, said flexible bar being located up to about one-half of said folded length from said grasping portion of said first sheet toward said lateral fold, and said flexible bar being firmly affixed to said side edges;

whereby when said consumer opens said closure said grasping portion of said first sheet is presented for grasping, and whereby upon grasping said grasping portion of said first sheet and withdrawing said first sheet from said package through said dispensing edge, said flexible bar automatically causes said lateral folds of said first sheet to substantially unfold, and said grasping portion of said additional sheet is thus presented adjacent to said dispensing edge for a subsequent use.

12. The flexible package of claim 11, wherein said thin, flexible material is substantially liquid impervious.

13. The flexible package of claim 12, wherein said edges join said front side and said back side together with a substantially liquid-tight and air-tight seal.

14. The flexible package of claim 13, wherein said seal is formed by thermally bonding said front side and said back side together.

15. The flexible package of claim 14, wherein said dispensing edge is releasably sealed by a resealable closure.

16. The flexible package of claim 15, wherein said closure comprises a resealable flap folded downward over said open end.

17. The flexible package of claim 16, wherein said flexible bar is located up to about one-fourth of said folded length from said grasping portion of said first sheet toward said lateral fold.

18. The flexible package of claim 17, wherein said sheet is moistened with a cleansing agent.

19. The flexible package of claim 17, wherein said sheet is substantially free of moisture.

20. The flexible package of claim 17, wherein said flexible bar is formed of a thin, flexible sheet material.

21. The flexible package of claim 17, wherein said flexible bar is formed of a thin, flexible cord material.

* * * * *